US009904199B2

(12) United States Patent
Terada et al.

(10) Patent No.: US 9,904,199 B2
(45) Date of Patent: Feb. 27, 2018

(54) CHARGING MEMBER HAVING OUTER SURFACE WITH CONCAVE PORTIONS BEARING EXPOSED ELASTIC PARTICLES, AND ELECTROPHOTOGRAPHIC APPARATUS

(71) Applicant: CANON KABUSHIKI KAISHA, Tokyo (JP)

(72) Inventors: Kenya Terada, Suntou-gun (JP); Takumi Furukawa, Susono (JP); Hiroaki Watanabe, Odawara (JP); Yuya Tomomizu, Yokohama (JP); Toshiro Suzuki, Gotemba (JP); Kenichi Yazawa, Suntou-gun (JP); Kazuhiro Gesho, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/332,437

(22) Filed: Oct. 24, 2016

(65) Prior Publication Data

US 2017/0115591 A1 Apr. 27, 2017

(30) Foreign Application Priority Data

Oct. 26, 2015 (JP) ..... 2015-210021
Aug. 9, 2016 (JP) ..... 2016-156601

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
USPC ..... 399/176
See application file for complete search history.

(56) References Cited

U.S. PATENT DOCUMENTS

| | | | |
|---|---|---|---|
| 4,420,548 | A | 12/1983 | Sakai et al. |
| 5,198,685 | A | 3/1993 | Kitani et al. |
| 7,693,457 | B2 | 4/2010 | Kuruma et al. |
| 7,962,068 | B2 | 6/2011 | Kuroda et al. |
| 8,440,307 | B2 | 5/2013 | Nose et al. |
| 8,445,113 | B2 | 5/2013 | Furukawa et al. |
| 8,469,867 | B2 | 6/2013 | Kuroda et al. |
| 8,481,167 | B2 | 7/2013 | Watanabe et al. |
| 8,491,994 | B2 | 7/2013 | Harada et al. |
| 8,501,312 | B2 | 8/2013 | Watanabe et al. |
| 8,501,325 | B2 | 8/2013 | Tomomizu et al. |
| 8,503,911 | B2 | 8/2013 | Suzumura et al. |
| 8,526,857 | B2 | 9/2013 | Tomomizu et al. |
| 8,532,535 | B2 | 9/2013 | Nose et al. |
| 8,538,298 | B2 | 9/2013 | Harada et al. |

(Continued)

FOREIGN PATENT DOCUMENTS

JP 2003-316111 11/2003

*Primary Examiner* — Billy Lactaoen
(74) *Attorney, Agent, or Firm* — Fitzpatrick Cella Harper and Scinto

(57) ABSTRACT

Provided a charging member including an electro-conductive support and a surface layer, the surface layer having in an outer surface thereof, concave portions and holding an elastic particle in each of the concave portions, the elastic particle being exposed at a surface of the charging member to form a convex portion in the surface of the charging member, and a part of a wall of each of the concave portions constituting a part of the surface of the charging member.

5 Claims, 5 Drawing Sheets

(56) References Cited

U.S. PATENT DOCUMENTS

| | | | | |
|---|---|---|---|---|
| 8,622,881 | B1 | 1/2014 | Harada et al. | |
| 8,685,601 | B2 | 4/2014 | Nose et al. | |
| 8,750,762 | B2 | 6/2014 | Harada et al. | |
| 8,755,714 | B2 | 6/2014 | Nagamine et al. | |
| 8,923,732 | B2 | 12/2014 | Harada et al. | |
| 8,991,053 | B2 | 3/2015 | Watanabe et al. | |
| 9,360,833 | B2 | 6/2016 | Terada et al. | |
| 9,372,428 | B2 | 6/2016 | Kuroda et al. | |
| 9,372,429 | B2 | 6/2016 | Watanabe et al. | |
| 2012/0076535 | A1 | 3/2012 | Nagamine et al. | |
| 2013/0004206 | A1 | 1/2013 | Kuroda et al. | |
| 2013/0034369 | A1 | 2/2013 | Masu et al. | |
| 2013/0064571 | A1 | 3/2013 | Kodama et al. | |
| 2013/0272747 | A1* | 10/2013 | Watanabe | B05D 5/00 399/168 |
| 2014/0169826 | A1* | 6/2014 | Higaki | G03G 15/0258 399/100 |

* cited by examiner

CHARGING MEMBER HAVING OUTER SURFACE WITH CONCAVE PORTIONS BEARING EXPOSED ELASTIC PARTICLES, AND ELECTROPHOTOGRAPHIC APPARATUS

BACKGROUND OF THE INVENTION

Field of the Invention

The present invention relates to a charging member to be used for an electrophotographic apparatus, and to an electrophotographic apparatus.

Description of the Related Art

In Japanese Patent Application Laid-Open No. 2003-316111, as a charging member capable of uniformly charging, by applying only a DC voltage, a body to be charged, such as an electrophotographic photosensitive member, there is a disclosure of a charging member having two kinds of particles having a large particle diameter and a small particle diameter which are attached in its surface layer.

SUMMARY OF THE INVENTION

One aspect of the present invention is directed to the provision of a charging member capable of exhibiting stable charging performance over a long period of time. In addition, another aspect of the present invention is directed to the provision of an electrophotographic apparatus capable of stably forming a high-quality electrophotographic image.

According to one aspect of the present invention, there is provided a charging member, including:

an electro-conductive support; and a surface layer, in which:

the surface layer has, in an outer surface thereof, concave portions independent of each other, and holds an elastic particle in each of the concave portions;

the elastic particle is exposed at a surface of the charging member to form a convex portion in the surface of the charging member;

wherein, when each of the concave portions and the elastic particle held in each of the concave portions are orthogonally projected on a surface of the support and orthogonal projection image is obtained, in the orthogonal projection image, a site in which an outer edge of a projection image derived from each of the concave portions and an outer edge of a projection image derived from the elastic particle in the respective concave portions are separated, exists;

a part of a wall of each of the concave portions constitutes a part of the surface of the charging member;

the elastic particle has an elastic recovery power of 70% or more, and has a Martens hardness of 0.1 $N/mm^2$ or more and 3.0 $N/mm^2$ or less; and the Martens hardness of the elastic particle is lower than a Martens hardness measured at a surface of the part of the wall constituting the surface of the charging member.

According to another aspect of the present invention, there is provided an electrophotographic apparatus including the charging member.

Further features of the present invention will become apparent from the following description of exemplary embodiments with reference to the attached drawings.

DESCRIPTION OF THE EMBODIMENTS

Figure 1:
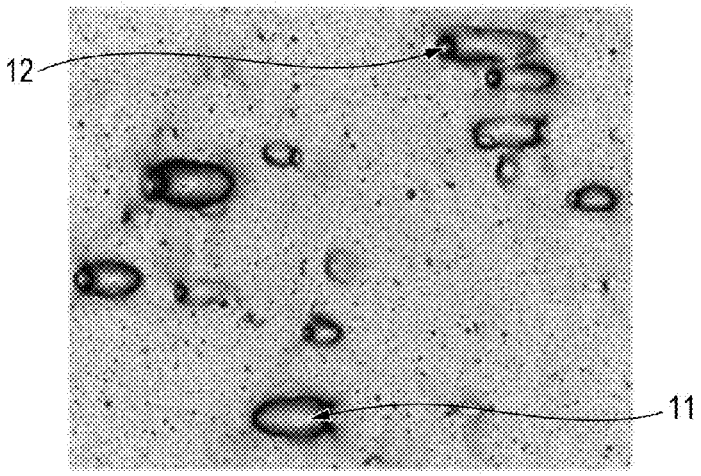
FIG. 1 is a photograph for showing an example of the surface form of a charging member.

Preferred embodiments of the present invention will now be described in detail in accordance with the accompanying drawings.

As a result of an investigation made by the inventors of the present invention, the inventors have recognized that a charging member having convex portions in its surface is effective in uniformly charging the body to be charged. However, when such charging member is used over a long period of time, contamination may accumulate on a surface of the body to be charged to gradually change chargeability. Meanwhile, the inventors have recognized that a charging member having no convex portions in its surface does not easily accumulate contamination on the surface of the body to be charged, and hence the chargeability does not easily change. However, use of such charging member may be disadvantageous in uniformly charging the body to be charged owing to the absence of the convex portions in the surface.

The inventors of the present invention thus have conducted studies in order to provide a charging member that can stably and uniformly charge a body to be charged over a long period of time, and consequently have completed the present invention.

A charging member according to one aspect of the present invention includes an electro-conductive support and a surface layer that is typically electro-conductive. The surface layer may be formed of an electro-conductive elastic material. The surface of the surface layer has concave portions. An elastic particle is held in each of the concave portions. As used herein, the term, "concave portion" does not mean only a portion recessed in the charging member that is a finished product, but means a recess in the surface layer (typically the surface of the electro-conductive elastic material) including a portion occupied by the elastic particle as well.

In addition, the surface of the charging member (in particular, a portion of the charging member in which the surface layer is present) has convex portions. The convex portions are each formed of the elastic particle. The elastic particle is not buried in a constituent material for the surface layer (except for the elastic particle), but is protruded in a state of being partially exposed from the constituent material for the surface layer (except for the elastic particle).

In addition, in an orthogonal projection image obtained by orthogonally projecting each of the concave portions and the elastic particle held in the concave portion on the surface of the support, a site in which the outer edge of a projection image derived from the concave portion and the outer edge of a projection image derived from the elastic particle are separated, exists. In this site, there is a gap surrounded by a wall of the elastic particle and a wall of the concave portion. The depth of the gap is preferably ⅓ or more of the average particle diameter of the elastic particle. A part of the wall of each of the concave portion constitutes a part of the surface of the charging member. In other words, at least part of the wall of each of the concave portions is exposed at the surface instead of being covered with the elastic particle.

In addition, the Martens hardness of the elastic particle is 0.1 $N/mm^2$ or more and 3.0 $N/mm^2$ or less. In addition, the Martens hardness of the elastic particle is lower than a Martens hardness measured at a surface of the part of the wall constituting a part of the surface of the charging member (hereinafter sometimes referred to as "gap-forming concave portion wall").

The inventors of the present invention have assumed as follows with regard to a mechanism by which the charging member according to the present invention suppresses contamination despite having the convex portions each derived from the elastic particle.

Figure 2A:
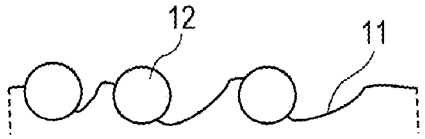
FIG. 2A is a schematic view for illustrating an example of the surface shape of the charging member.
Figure 2B:
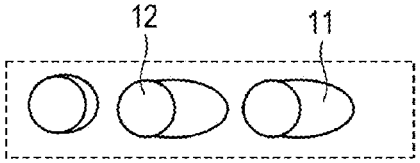
FIG. 2B is a schematic view for illustrating an example of the surface shape of the charging member.

First, FIG. 1 is an illustration of an example of the surface of the charging member according to one aspect of the present invention. FIG. 2A is a projection view (cross-sectional view) from a point of view in a tangential direction with respect to the surface of the charging member, and FIG. 2B is a projection view from a point of view in a normal direction with respect to the surface of the charging member. The surface of the charging member refers to a surface to be brought into contact with a body to be charged or a surface to be brought into proximity therewith. In addition, the charging member generally has a predetermined surface roughness, and a surface serving as a reference for defining the normal direction or the tangential direction with respect to the surface of the charging member is set to a surface passing through the average line of the surface roughness in a height direction. An electro-conductive rubber composition serving as a material for forming the surface layer forms concave portions 11. In this manner, concave portions independent of each other are present in the outer surface of the surface layer. In each of the concave portions 11, the elastic particle is present. In the projection view from a point of view in the normal direction with respect to the surface of the charging member, at least part of the outer edge of the elastic particle and the outer edge of the concave portion in which the elastic particle is present are present in a separate state. In other words, in this projection view, there is a site in which the outer edge of a projection image derived from the elastic particle and the outer edge of a projection image derived from the concave portion are separated. In this site, there is a gap surrounded by a wall of the elastic particle and a wall of the concave portion. The elastic particle forms a convex portion 12. In each of the concave portions 11, an elastic particle having a Martens hardness of 0.1 $N/mm^2$ or more and 3.0 $N/mm^2$ or less is present. The elastic particle to be used in the present invention has an elastic recovery power in the measurement of the Martens hardness of 70% or more. Further, the Martens hardness of the elastic particle is lower than a Martens hardness of the gap-forming concave portion wall.

With such charging member, the elastic particle forms the convex portion 12 in the surface of the charging member. Accordingly, in a discharge region before abutting on a photosensitive member, i.e. the body to be charged can be uniformly charged. On the photosensitive member, toner adhering unintendedly because of, for example, a failure to be completely removed by a cleaning member is present in some cases. In addition, when the toner is brought into contact with the elastic particle, the toner is crushed to adhere, which serves as the origin of expansion of the adhesion of the toner. As a result, spot-like unevenness in image density (hereinafter referred to as "spot-like contamination") may be generated. The convex portion formed by the elastic particle having a Martens hardness of 3.0 $N/mm^2$ or less deforms in the tangential direction of the surface of the surface layer in the abutting portion with the photosensitive member toward the gap formed between the outer edges of the concave portion 11 and the elastic particle. In this case, the Martens hardness of the gap-forming concave portion wall is higher than that of the elastic particle, and hence the elastic particle can deform. In other words, the height of the convex portion 12 derived from the elastic particle is lowered to suppress the crushing of toner sandwiched between the convex portion and the photosensitive member. This effect is most effective when the elastic particle is exposed at the surface of the charging member. When the gap formed by separation of the outer edges of the elastic particle and the concave portion is absent, there is no place to which the elastic particle escapes when a load is applied thereto. Accordingly, an increase in stress to the elastic particle caused by the load is larger than in the case where the gap is present, with the result that the toner is crushed.

Then, after separation from the photosensitive member after passing through the abutting nip with the photosensitive member, the height of the convex portion 12 returns to the original state, and the distance between the charging member and the photosensitive member is increased. Thus, performance of uniformly charging the body to be charged is maintained. As described above, by virtue of the construction of the present invention, in which the height of the convex portion can be greatly changed between when the charging member abuts on the photosensitive member and when the charging member does not abut thereon, the photosensitive member can be uniformly charged and an image resulting from spot-like contamination can be suppressed.

In addition, when the Martens hardness or the elastic particle is more than 0.1 $N/mm^2$, unevenness in image density due to a difference in adhesion amount of an external additive (hereinafter referred to as "stepped unevenness-like contamination") can be easily suppressed. The difference in adhesion amount of the external additive occurs as a result of deposition through burial of the external additive adhering to the elastic particle into the elastic particle, correspondingly to the generation of a fluctuation in roller thickness in a space between the charging member and the photosensitive member.

The Martens hardness of the elastic particle is preferably 0.1 $N/mm^2$ or more and 0.3 $N/mm^2$ or less, more preferably 1.0 $N/mm^2$ or more and 2.0 $N/mm^2$ or less. When the Martens hardness of the elastic particle is 1.0 $N/mm^2$ or more, sinking of the external additive into the elastic particle due to the elastic particle being soft can be further suppressed. In addition, when the Martens hardness of the elastic particle is 2.0 $N/mm^2$ or less, the change in stress to the elastic particle through the deformation of the elastic particle (in the tangential direction of the charging member) to the gap caused by the abutment of the charging member and the photosensitive member on each other is further small. Accordingly, the crushing of toner in the case where the toner is present on the elastic particle can be further suppressed.

In addition, the Martens hardness of the gap-forming concave portion wall is preferably 5.0 $N/mm^2$ or more and 20.0 $N/mm^2$ or less. When the Martens hardness of the gap-forming concave portion wall is 5.0 $N/mm^2$ or more, stepped unevenness-like contamination due to the adhesion of the external additive to the gap can be suppressed. The gap-forming concave portion wall, unlike the elastic particle, is not directly brought into contact with the photosensitive member, and hence it is assumed that the adhesion of the external additive cannot be suppressed unless the Martens hardness is still higher than that of the elastic particle. When the Martens hardness of the gap-forming concave portion wall is 20.0 $N/mm^2$ or less, cracking of toner due to the gap-forming concave portion wall being hard can be suppressed.

Further, the average particle diameter of the elastic particle is preferably 6 μm or more and 30 μm or less.

When the average particle diameter is 6 μm or more, horizontal streak-like image unevenness that occurs owing to intermittent generation of discharge downstream in the rotation direction of the photosensitive member due to the lack of upstream discharge can be easily suppressed. In addition, when the particle diameter is 30 μm or less, the generation of spot-like contamination due to the accumulation of toner in the surroundings of the elastic particle can be easily suppressed.

Figure 2C:
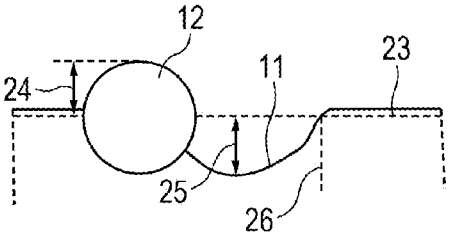
FIG. 2C is a schematic view for illustrating an example of the surface shape of the charging member.

A height 24 of the convex portion 12 of the elastic particle (FIG. 2C) is higher than the height of an average line 23 of the height of a surface shape, and is preferably higher by 3 μm or more. As the height of the convex portion increases, the suppressive effect on horizontal streak-like image unevenness increases.

A depth 25 of the gap surrounded by the wall of the elastic particle and the wall of the concave portion is lower than the average line 23 of the height of the surface shape, and the depth of the gap is preferably ⅓ or more of the average particle diameter of the elastic particle.

An outer edge 26 of the projection image derived from the concave portion is defined as the periphery of the concave portion serving as a point of intersection between the contour of the concave portion and the average line of the height. In addition, the outer edge of the projection image derived from the elastic particle means an outer edge formed by the contour of the elastic particle in the orthogonal projection image. As used herein, the terms "outer edge of the concave portion" and "outer edge of the elastic particle" mean "the outer edge of the projection image derived from the concave portion" and "the outer edge of the projection image derived from the elastic particle," respectively, unless otherwise stated.

Figure 2D:
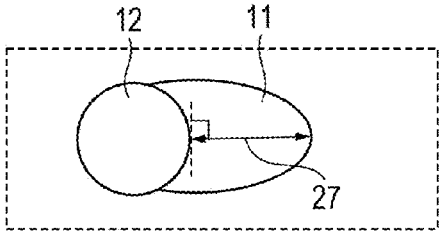
FIG. 2D is a schematic view for illustrating an example of the surface shape of the charging member.

The distance of the site in which the outer edge of the projection image derived from the elastic particle and the outer edge of the projection image derived from the concave portion are separated in the projection view from the point of view in the normal direction with respect to the surface of the charging member (hereinafter sometimes referred to as "gap portion distance") is described. A gap portion distance 27 is defined as the longest line segment out of line segments formed by lines each drawn from one certain point of the outer edge of the elastic particle in a normal direction and points of intersection between the lines and the outer edge of the concave portion in a projection view on the surface from the point of view in the normal direction with respect to the surface of the charging member (FIG. 2D). The gap portion distance 27 is preferably ⅓ or more of the average particle diameter (Dp) of the elastic particle and 70 μm or less (FIG. 2D). In the case where the gap portion distance 27 is ⅓ or more of the average particle diameter of the elastic particle, a space in which the convex portion derived from the elastic particle can sufficiently deform when the charging member and the photosensitive member abut on each other can be held, and hence a spot-like contamination image resulting from the crushing of toner can be easily suppressed. When the gap portion distance 27 is 70 μm or less, toner contamination and stepped unevenness-like contamination resulting from the accumulation of the toner or the external additive in the portion in which the outer edge of the elastic particle and the outer edge of the concave portion are separated can be easily suppressed.

The shape of the concave portion is not particularly limited, and is, for example, hemispherical, hemiellipsoidal, or amorphous. Examples of the shape of the concave portion are illustrated in FIG. 6A to FIG. 6F. FIG. 6A to FIG. 6F are each a projection view from a point of view in a normal direction with respect to the surface of the charging member. In each of FIG. 6A to FIG. 6F, the elastic particle is represented by a black filled circle. It is more preferred that at least part of the portion in which the outer edge of an elastic particle 112 and the outer edge of the concave portion are separated be located between an alternate long and short dash line (line at a distance ⅓ of the average particle diameter Dp of the elastic particle from the elastic particle) and an alternate long and two short dashes line (line at a distance of 70 μm from the elastic particle).

The number of the concave portions (concave portions in each of which the elastic particle is present) is not particularly limited, and may be, for example, about 0.2 or more and about 10.0 or less per 100 μm square in the surface of the surface layer. A concave portion in which no elastic particle is present, or an elastic particle that is not present in a concave portion may be present.

Figure 7:
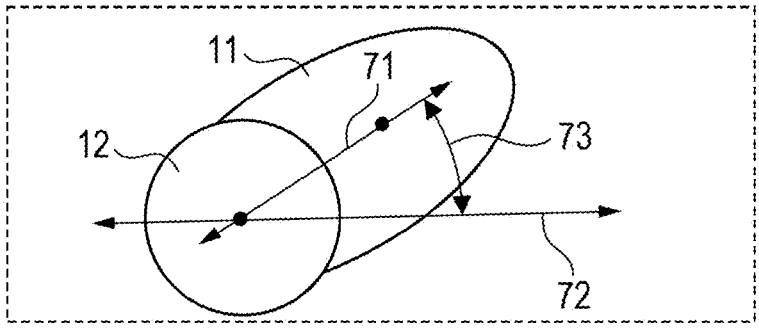
FIG. 7 is a schematic view for describing the orientation of the position of the center of gravity of a gap with respect to the position of the center of gravity of an elastic particle.

Further, in the projection view from the point of view in the normal direction with respect to the surface of the charging member, the position of the center of gravity of the gap surround by the outer edge of the elastic particle and the outer edge of the concave portion is preferably oriented in the longitudinal direction of the charging member (axis direction in the case of a charging roller) with respect to the position of the center of gravity of the elastic particle. This is because the ameliorating effect on horizontal streak-like charging member contamination expanding in the longitudinal direction of the charging member is further increased. The degree of the orientation may be represented by the average value of an acute angle 73 formed, in a projection view (FIG. 7) from a point of view in a normal direction with respect to the surface of the charging member, between a direction 71 connecting the center of gravity of the elastic particle and the center of gravity of the gap, and a longitudinal direction 72 of the charging member. This value is from 0° to 90°. 90° indicates orientation in a direction orthogonal to the longitudinal direction (rotation direction in the case of a charging roller), 45° indicates no orientation, and 0° indicates orientation in the longitudinal direction. That is, when the angle is less than 45°, the elastic particle and the gap are oriented in the longitudinal direction of the charging member. The angle is preferably 0° or more and 20° or less.

Now, preferred embodiments of the present invention are described in detail.

<Charging Member>

Figure 3:
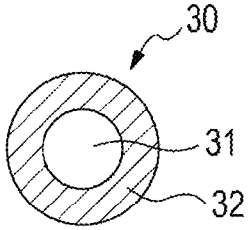
FIG. 3 is a schematic view for illustrating an example of the construction of a charging roller.

FIG. 3 is a construction view of a charging roller serving as an example of the charging member of the present invention.

A charging roller 30 includes a mandrel 31 serving as the electro-conductive support, and a surface layer 32 formed on the mandrel 31.

Next, the constituent elements of the charging member are described one by one.

(Low-Hardness Elastic Particles)

At the surface layer to be used in the present invention, low-hardness elastic particles are exposed. The Martens hardness of each of the low-hardness elastic particles is preferably 0.1 $N/mm^2$ or more and 3.0 $N/mm^2$ or less. The Martens hardness of each of the elastic particles may be measured with a microhardness meter (trade name: PICODENTOR HM500, manufactured by Fischer Instruments K.K.). A square pyramid-shaped diamond may be used as an indenter for the measurement. A driving speed is set to a condition represented by the following equation (1):

$$dF/dt=0.04 \text{ mN}/10 \text{ s} \quad (1)$$

where F represents force, and t represents time.

With the use of a microscope included with the microhardness meter, the indenter is brought into contact with the elastic particle, and the maximum hardness is defined as the Martens hardness of the elastic particle.

In addition, the elastic recovery power of each of the low-hardness elastic particles is preferably 70% or more. This is because in the case where the elastic recovery power of each of the elastic particles is 70% or more, even when the charging member and the photosensitive member abut on each other to lower the height of each of the convex portions derived from the elastic particles, after separation of the charging member and the photosensitive member, the height easily returns to a height sufficient, for the convex portions to maintain charging uniformity. The elastic recovery power of each of the elastic particles may be measured with a microhardness meter (trade name: PICODENTOR HM500, manufactured by Fischer Instruments K.K.). A square pyramid-shaped diamond may be used as an indenter for the measurement. A driving speed is set to the condition represented by the equation (1).

With the use of a microscope included with the microhardness meter, the indenter is brought into contact with the elastic particle, a load is then reduced, and an indentation depth and the load are measured until the load becomes 0. The elastic recovery power (We %) is determined by the following equation (2) using driving elastic deformation recovery work (We) and mechanical driving total work (Wt).

$$We\ \%=We/Wt\times 100 \quad (2)$$

The form of the elastic particle in the measurement of the Martens hardness and the elastic recovery power may be its raw material itself, or may be the elastic particle exposed from the charging roller.

A material for the elastic particles is not particularly limited. For example, the particles are made of at least one resin selected from a phenol resin, a silicone resin, a polyacrylonitrile, a polystyrene, a polyurethane, a nylon resin, a polyethylene, a polypropylene, an acrylic resin, and the like, and a plurality of kinds of those resins may be used as a blend.

The average particle diameter of the elastic particles is preferably 6 μm or more and 30 μm or less. When the average particle diameter is 6 μm or more, a horizontal streak-like image failure that occurs owing to intermittent generation of discharge downstream in the rotation direction of the photosensitive member due to the lack of upstream discharge can be easily suppressed. In addition, when the average particle diameter is 30 μm or less, the generation of spot-like contamination resulting from the accumulation of toner in the surroundings of the elastic particles can be easily suppressed.

The surface of the surface layer is roughened by the elastic particles. With regard to the degree of the roughening of the surface, the surface of the elastic layer preferably has a ten-point average roughness Rz (based on JIS B0601: 1982) of 6 μm or more and 30 μm or less. When the Rz is 6 μm or more, a horizontal streak-like image failure that occurs owing to intermittent generation of discharge downstream in the rotation direction due to the lack of upstream discharge resulting from a small surface roughness can be easily suppressed. When the Rz is 30 μm or less, the generation of fogging due to the lack of local discharge between a trough portion of the surface shape and the photosensitive member can be easily suppressed.

The average particle diameter of the elastic particles is a "length-average particle diameter" to be determined by the following method.

First, the elastic particles are observed with a scanning electron microscope (manufactured by JEOL Ltd., trade name: JEOL LV5910), and an image is taken. The taken image is analyzed using image analysis software (trade name: Image-Pro Plus, manufactured by Planetron, Inc.). The analysis is performed as described below. The number of pixels per unit length is calibrated based on a micron bar at the time of photographing. For each of 100 elastic particles randomly selected from the photograph, a unidirectional diameter is measured from the number of pixels on the image, and an arithmetic average particle diameter is determined and defined as the average particle diameter of the elastic particles.

Further, with regard to the sphericity of the elastic particles, the average value of a shape coefficient SF1 described below is preferably 100 or more and 160 or less. Herein, the shape coefficient SF1 is an index represented by the following equation (3), and indicates higher closeness to a spherical shape as its value approaches 100. In the case where the average value of the shape coefficient is 160 or less, even when the elastic particles are exposed at the surface of the elastic layer and brought into direct contact with the photosensitive member, abrasion of and damage to the photosensitive member can be easily suppressed.

The shape coefficient SF1 of the elastic particles to be used in the present invention may be measured by the following method. As in the measurement of the particle diameter, image information taken with the scanning electron microscope is input into an image analyzer (manufactured by Nireco Corporation, trade name: Lusex3), and for each of randomly selected 50 particle images, SF1 is calculated by the following equation (3). The average value is obtained by determining the arithmetic average of the calculated SF1 values.

$$SF1=\{(MXLNG)^2/\text{AREA}\}\times(\pi/4)\times(100) \quad (3)$$

where MXLNG represents the absolute maximum length of a particle, and AREA represents the projected area of the particle.

As the elastic particles to be exposed at the surface of the surface layer, two or more kinds of elastic particles may be used in combination, and elastic particles formed of a copolymer of resins may also be used.

(Gap-Forming Concave Portion Wall Having Hardness Higher than that of Elastic Particles)

In the surface layer (elastic layer) to be used in the present invention, a gap-forming concave portion wall having a hardness higher than that of each of the elastic particles is present. The Martens hardness of an elastic material forming the gap-forming concave portion wall is preferably 5.0 $N/mm^2$ or more.

The Martens hardness of the gap-forming concave portion wall may be measured with a microhardness meter (trade name: PICODENTOR HM500, manufactured by Fischer Instruments K.K.). A square pyramid-shaped diamond may be used as an indenter for the measurement. A driving speed is set to the condition represented by the equation (1).

With the use of a microscope included with the microhardness meter, the indenter is brought into contact with the surface of a part of the concave portion's wall constituting a part of a surface of the charging member to measure its maximum hardness. The measured value is defined as the Martens hardness of the gap-forming concave portion wall.

As an example of the state of presence of the gap-forming concave portion wall having a hardness higher than that of each of the elastic particles, there may be given a concave portion formed by recessing of part of an elastomer composition formed at the surface of the surface layer (elastic layer). The elastomer composition is an elastomer composition obtained by appropriately blending an electro-conductive agent, a crosslinking agent, and the like into a raw material elastomer.

As a material for the surface layer, there may be used an electro-conductive elastomer formed of a rubber, a thermoplastic elastomer, or the like, which has heretofore been used for an electro-conductive elastic layer of a charging member, e.g., an electro-conductive elastic layer of a charging roller for an electrophotographic apparatus.

A rubber or a rubber composition containing a polyurethane rubber, a silicone rubber, a butadiene rubber, an isoprene rubber, a chloroprene rubber, a styrene-butadiene rubber, an ethylene-propylene rubber, a polynorbornene rubber, a styrene-butadiene-styrene rubber, an epichlorohydrin rubber, or the like is suitably used as the rubber.

The kind of the thermoplastic elastomer is not particularly limited, and a thermoplastic elastomer or thermoplastic elastomer composition containing one kind or a plurality of kinds of thermoplastic elastomers selected from a generally used styrene-based elastomer, olefin-based elastomer, amide-based elastomer, urethane-based elastomer, ester-based elastomer, and the like may be suitably used.

The conduction mechanism of an electro-conductive elastomer composition is broadly classified into two, i.e., an ionic conduction mechanism and an electronic conduction mechanism.

The electro-conductive elastomer composition of the ionic conduction mechanism is generally formed of a polar elastomer typified by an epichlorohydrin rubber, a chloroprene rubber, or an acrylonitrile-butadiene rubber (NBR), and an ionic conductive agent. The ionic conductive agent is an ionic conductive agent that ionizes in the polar elastomer, and that has high mobility of an ion generated by the ionization. However, the electro-conductive elastomer composition of the ionic conduction mechanism has high environment dependence of electrical resistance, and is sometimes liable to cause bleeding and blooming due to the mechanism in which conductivity is expressed by the migration of ions.

On the other hand, the electro-conductive elastomer composition based on the electronic conduction mechanism is generally obtained by dispersing, in an elastomer, electro-conductive particles of, for example, carbon black, carbon fiber, graphite, metal fine powder, or a metal oxide, to composite the elastomer and the electro-conductive particles. The electro-conductive elastomer composition of the electronic conduction mechanism has advantages such as having lower temperature and humidity dependence of electrical resistance, causing less bleeding and blooming, and being less expensive, as compared to the electro-conductive elastomer composition of the ionic conduction mechanism.

For the charging member, it is desired that the appearance of the abutting portion as an image failure be suppressed when the charging member is left to stand in abutment on an electrophotographic photosensitive member for a long period of time without being used. Accordingly, the electro-conductive elastomer of the electronic conduction mechanism, which causes less bleeding and blooming, is preferably used.

Examples of the electro-conductive particles include: electro-conductive carbon, such as ketjen black EC and acetylene black; carbon for rubber, such as SAF, ISAF, HAF, FEF, GPF, SRF, FT, and MT; oxidation-treated carbon for color (ink), pyrolytic carbon, natural graphite, and artificial graphite; and metals and metal oxides, such as tin oxide, titanium oxide, zinc oxide, copper, and silver. It is preferred that the electro-conductive particles not form large convex portions. Accordingly, electro-conductive particles having an average particle diameter of from 10 nm to 300 nm are preferably used.

The loading amount of the electro-conductive particles may be appropriately selected depending on the kinds of the raw material elastomer, the electro-conductive particles, and any other blending agent, so that the electro-conductive elastic layer (surface layer) has a desired electrical resistance. For example, the loading amount may be set to 0.5 part by mass or more and 100 parts by mass or less, preferably 2 parts by mass or more and 60 parts by mass or less with respect to 100 parts by mass of the polymer (raw material elastomer).

In addition, the elastomer composition may contain another electro-conductive agent, a filler, a processing aid, an antioxidant, a crosslinking aid, a crosslinking accelerator, a crosslinking accelerator aid, a crosslinking retarder, a dispersant, and the like.

(Surface Layer)

Herein, the surface layer means a surface layer formed of an elastic material. The surface layer may be multilayered. However, when the surface layer is multilayered, it is necessary that a layer containing the elastic particles be formed as the outermost surface. In addition, an adhesive layer may be formed between the electro-conductive support and the elastic layer.

In the present invention, in order to simplify a production process, the surface layer is most preferably a single layer. In addition, the thickness of the surface layer in this case falls within the range of preferably from 0.8 mm or more to 4.0 mm or less, particularly preferably from 1.2 mm or more to 3.0 mm or less, in order to ensure a nip width with the body to be charged (photosensitive member).

Further, as a method of forming the specific surface of the charging member of the present invention, a method involving using the surface of an elastic layer formed by crosshead extrusion as it is, is preferred for the simplification of the production process.

Further, for the purpose of, for example, making the surface of the surface layer non-adherent or preventing bleeding and blooming from the inside of the surface layer, surface treatment involving irradiation with UV light or an electron beam may be performed.

(Electro-Conductive Support)

The electro-conductive support only needs to be one having conductivity, being capable of supporting a surface layer or the like layers, and being capable of maintaining strength as a charging member, typically as a charging roller.

<Manufacturing Method for Charging Member>

As an example of a manufacturing method for the charging member of the present invention, a method that is effective from the viewpoint that its manufacturing steps are simple is described. That is, a manufacturing method involving forming, by extrusion molding, a surface which has concave portions in which low-hardness elastic particles are present, which has convex portions formed by the elastic particles, and in which at least part of the outer edges of the concave portions and the convex portions are separated to form a gap is described.

The manufacturing method is a manufacturing method for a charging roller, including the following two steps, to form, in its surface, a concave portion in which an interface between an elastic particle and an electro-conductive rubber composition is peeled:

a step of preparing an unvulcanized rubber composition that is formed of the electro-conductive rubber composition and the elastic particles having an average particle diameter of 6 μm or more and 30 μm or less, and that has its elongation at break controlled to an appropriate value; and a step of integrally subjecting the unvulcanized rubber composition and a mandrel to crosshead extrusion molding while elongating the unvulcanized rubber composition so that a take-up ratio (to be described later) in extrusion molding is 100% or less.

First, the unvulcanized rubber composition containing the electro-conductive rubber composition and the low-hardness elastic particles, for forming the surface layer, is prepared.

The content of the elastic particles in the unvulcanized rubber composition is preferably 5 parts by mass or more and 50 parts by mass or less with respect to 100 parts by mass of a raw material rubber. When the content is 5 parts by mass or more, the elastic particles cars be easily present in a sufficient amount in the surface, and thus a horizontal streak can be more suppressed. In addition, when the content is 50 parts by mass or less, the generation of spot contamination resulting from an increased blending amount of the elastic particles can be more suppressed.

The inventors of the present invention have found that the gap portion distance can be controlled based on the elongation at break of the unvulcanized rubber in a tensile test. The elongation at break is measured using a tensile tester (trade name: RTG-1225, manufactured by A&D Company, Limited) in accordance with JIS K6254-1993. In this case, the measurement is performed under the conditions of a tension speed of 500 mm/minute, a breaking point measurement sensitivity of 0.01 N, a gauge length of 20 mm, a sample width of 10 mm, a thickness of 2 mm, a test temperature of 25° C., and a number of times of measurement of 2.

The elongation at break is considered to serve as an indicator of stress relaxation through the generation of a microcrack (void) having a diameter of 3 μm or less. Accordingly, a gap formed by peeling of an interface between each of the elastic particles and the electro-conductive elastomer through the concentration of stress at the interface is not easily generated when the stress is easily relaxed by the microcrack. In other words, the gap may be said to be not easily generated in an unvulcanized rubber having small elongation at break. In order to control the stress relaxation by the microcrack, a filler having a low reinforcing property is preferably mixed in the unvulcanized rubber composition. In particular, calcium carbonate is preferred because calcium carbonate allows the elongation at break to be adjusted over a wide range depending on its addition amount. In order to form a gap having an appropriate size, the elongation at break is preferably 50% or more and 80% or less.

In addition to the foregoing, the formation of the gap by peeling may also be controlled by the Mooney viscosity of the unvulcanized rubber composition, a difference in polarity between each of the elastic particles and the electro-conductive rubber composition, and a pressure-sensitive adhesive property. A raw material rubber having a higher Mooney viscosity allows the gap to be increased.

With the use of the unvulcanized rubber composition, in order to form the gap by peeling the interface between each of the elastic particles and the electro-conductive rubber composition, the unvulcanized rubber composition is molded while being pushed with a mandrel through the use of a crosshead extrusion molding machine. The crosshead extrusion molding machine is a molding machine configured such that the unvulcanized rubber composition and a mandrel having a predetermined length are simultaneously fed, and an unvulcanized rubber roller including the mandrel having an outer periphery uniformly coated with a rubber material having a predetermined thickness is extruded from a discharge port of a crosshead.

Figure 4A:
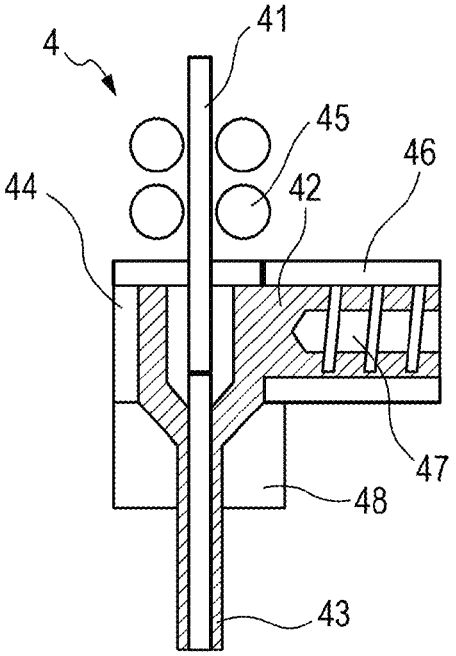
FIG. 4A is a schematic mechanism view of an example of a crosshead extrusion molding machine.

FIG. 4A is a schematic construction view of a crosshead extrusion molding machine 4. The crosshead extrusion molding machine 4 is an apparatus for uniformly covering a mandrel 41 over its entire periphery with an unvulcanized rubber composition 42, to manufacture an unvulcanized rubber roller 43 having the mandrel 41 inserted in its center.

The crosshead extrusion molding machine 4 includes: a crosshead 44 into which the mandrel 41 and the unvulcanized rubber composition 42 are to be fed; conveying rollers 45 configured to feed the mandrel 41 into the crosshead 44; and a cylinder 46 configured to feed the unvulcanized rubber composition 42 into the crosshead 44.

The conveying rollers 45 are configured to continuously feed a plurality of the mandrels 41 in an axis direction into the crosshead 44. The cylinder 46 includes a screw 47 in its inside, and is configured to feed the unvulcanized rubber composition 42 into the crosshead 44 by the rotation of the screw 47.

When the mandrel 41 is fed into the crosshead 44, its entire periphery is covered with the unvulcanized rubber composition 42 fed from the cylinder 46 into the crosshead. Then, the mandrel 41 is delivered out of a die 48 at the discharge port of the crosshead 44, as the unvulcanized rubber roller 43 having its surface covered with the unvulcanized rubber composition 42.

Figure 4B:
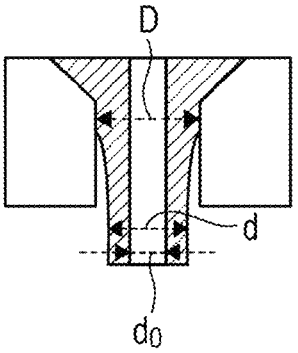
FIG. 4B is a schematic view of an example of the vicinity of a crosshead extrusion port.

The interface between each of the elastic particles and the electro-conductive rubber composition is peeled to form the gap by performing the molding so that the thickness of the unvulcanized rubber composition becomes small as compared to the clearance of the extrusion port of the crosshead, i.e., by performing the molding while stretching the unvulcanized rubber. FIG. 4B is a schematic view of the vicinity of the crosshead extrusion port. $(d-d_0)/(D-d_0)$, where D represents the inner diameter of the die at the crosshead extrusion port, d represents the outer diameter of the unvulcanized rubber roller at its center, and $d_0$ represents the outer diameter of the mandrel, corresponding to "(thickness of unvulcanized rubber composition at center)÷(clearance of extrusion port)," is defined as a take-up ratio (%). A value of the take-up ratio of 100% means that the thickness of the unvulcanized rubber composition is the same as the clearance of the extrusion port. A lower value of the take-up ratio indicates that the unvulcanized rubber composition is molded while being more stretched and a larger gap is formed. A take-up ratio of 90% or less and 80% or more allows the formation of a gap having an appropriate size, and hence is preferred. In general molding, the unvulcanized rubber composition discharged from the extrusion port is usually shrunk by die swell, resulting in a take-up ratio of 100% or more.

The adjustment of the take-up ratio is performed by changing a relative ratio between the mandrel feed rate of the mandrel 41 by the conveying rollers 45 and the feed rate of the unvulcanized rubber composition from the cylinder 46. In this case, the feed rate of the unvulcanized rubber composition 42 from the cylinder 46 into the crosshead 44 is made constant. The thickness of the unvulcanized rubber composition 42 is determined by the ratio between the feed rate of the mandrel 41 and the feed rate of the unvulcanized rubber composition 42.

The unvulcanized rubber composition is molded into a so-called crown shape in which the central portion of each of the mandrels 41 in its axis direction has an outer diameter (thickness) larger than that of an end portion thereof. Thus, the unvulcanized rubber roller 43 is obtained.

Then, when crosslinking is needed, the unvulcanized rubber roller is heated to provide a vulcanized rubber roller.

As specific examples of a method for heating treatment, there may be given: blast furnace heating with a gear oven; heating vulcanization with a far infrared ray; steam heating with a vulcanizer; and the like. Of those, blast furnace heating and far infrared ray heating are suitable for continuous production, and hence are preferred. When crosslinking is not needed, for example, when a surface layer is formed using a thermoplastic elastomer, a vulcanized rubber roller may be obtained by, for example, appropriately cooling the unvulcanized rubber roller.

The vulcanized rubber composition at each of both end portions of the vulcanized rubber roller is removed in a subsequent separate step, and thus the vulcanized rubber roller is finished. Therefore, both end portions of the mandrel of the finished vulcanized rubber roller are exposed.

The surface layer may be subjected to surface treatment involving irradiation with UV light or an electron beam.

As another manufacturing method, the following example is given.

First, an unvulcanized rubber composition containing a foaming agent is prepared. The unvulcanized rubber composition is subjected to extrusion molding into a vulcanized rubber roller. The surface of the vulcanized rubber roller is ground to expose concave portions resulting from voids formed by foaming. To the concave portions, thermoplastic elastic particles having diameters shorter than the long diameters of the concave portions are applied. After that, the resultant is heated at a temperature higher than the melting point of each of the thermoplastic elastic particles to cause the elastic particles to adhere to the concave portions.

Figure 5:
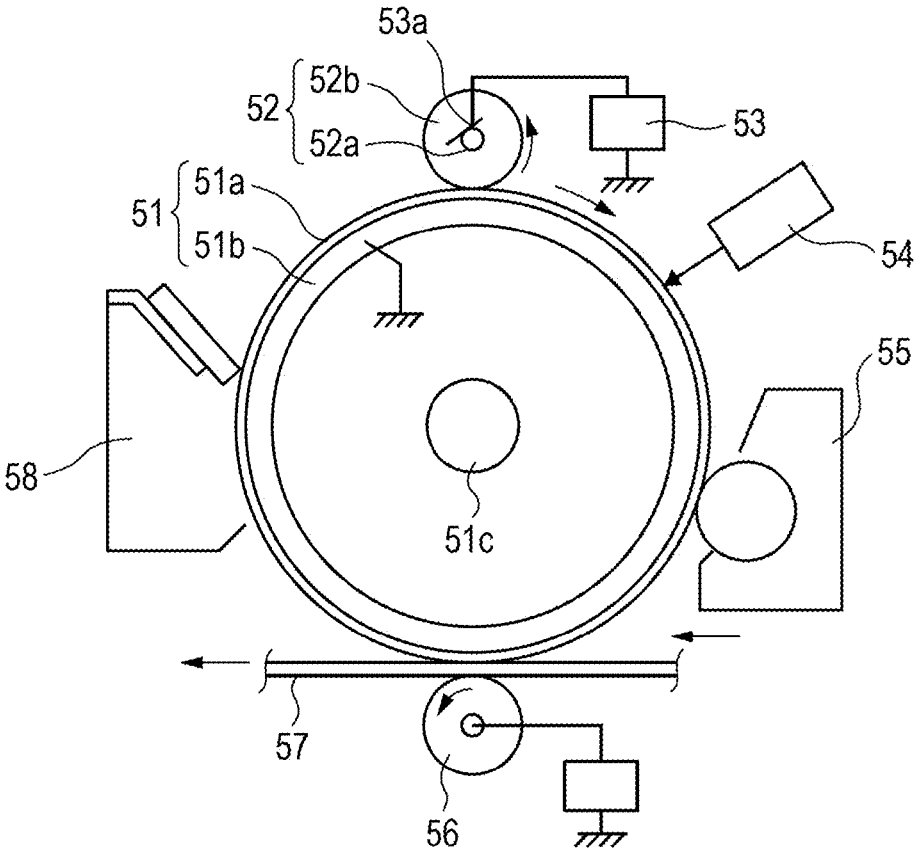
FIG. 5 is a construction view for schematically illustrating an example of an electrophotographic apparatus including the charging member.
Figure 6A:
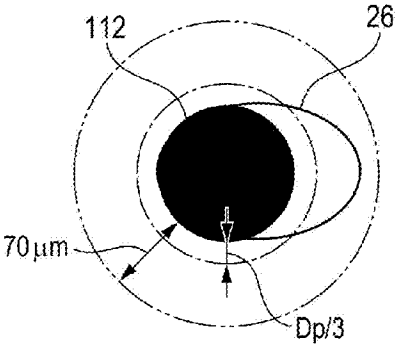
FIG. 6A is a schematic view for illustrating an example of the shape of a concave portion.
Figure 6B:
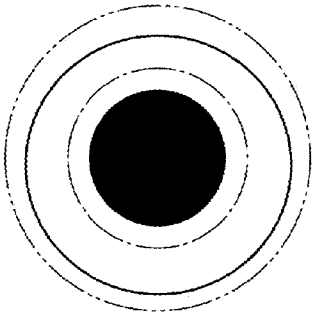
FIG. 6B is a schematic view for illustrating an example of the shape of the concave portion.
Figure 6C:
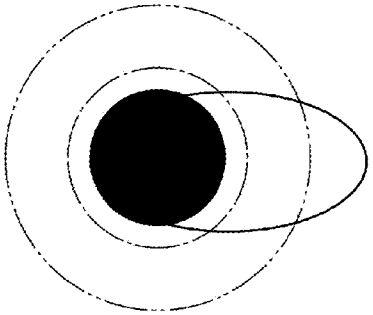
FIG. 6C is a schematic view for illustrating an example of the shape of the concave portion.
Figure 6D:
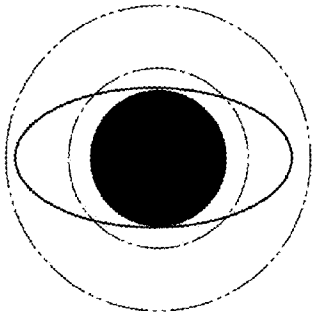
FIG. 6D is a schematic view for illustrating an example of the shape of the concave portion.
Figure 6E:
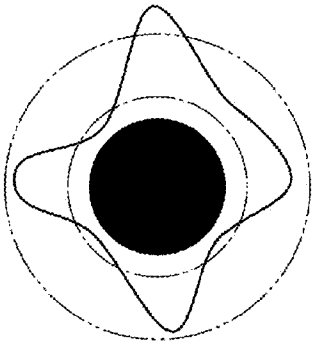
FIG. 6E is a schematic view for illustrating an example of the shape of the concave portion.
Figure 6F:
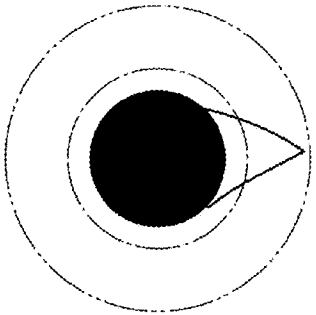
FIG. 6F is a schematic view for illustrating an example of the shape of the concave portion.

Next, an electrophotographic image forming process is described with reference to a construction view of an example of an electrophotographic apparatus including the charging member of the present invention (FIG. 5). An electrophotographic photosensitive member (photosensitive member) 51 serving as a body to be charged includes an electro-conductive support 51*b* and a photosensitive layer 51*a* formed on the support 51*b*, and has a cylindrical shape. In addition, the photosensitive member 51 is driven with a predetermined circumferential speed clockwise in FIG. 5 about an axis 51*c*. The member to be charged (photosensitive member 51) is capable of being charged by a charging member (charging roller 52).

The charging roller 52 is arranged in contact with the photosensitive member 51, and is configured to charge the photosensitive member to a predetermined potential. The charging roller 52 includes a mandrel 52*a* and a surface layer 52*b* formed on the mandrel 52*a*. Both end portions of the mandrel 52*a* are pressed by a pressing unit (not shown) against the electrophotographic photosensitive member 51. A predetermined DC voltage is applied to the mandrel 52*a* from a power source 53 via a rubbing-friction electrode 53*a*, and thus the photosensitive member 51 is charged to a predetermined potential.

Then, on the peripheral surface of the charged photosensitive member 51, electrostatic latent images corresponding to image information of interest are formed by an exposing unit 54. The electrostatic latent images are then sequentially visualized as toner images by a developing member 55. The toner images are sequentially transferred onto a transfer material 57.

The transfer material 57 is taken from a sheet feeding unit (not shown) in synchronization with the rotation of the photosensitive member 51, and is conveyed at proper timing to a transfer portion between the photosensitive member 51 and a transfer unit 56. The transfer unit 56 is a transfer roller, and is configured to charge the transfer material 57 from its back to the opposite polarity to that of the toner, to thereby transfer the toner images on the photosensitive member 51 side onto the transfer material 57. The transfer material 57 having the toner images transferred onto its surface is separated from the photosensitive member 51 and conveyed to a fixing unit (not shown), where the toner is fixed, and is output as an image-formed product. From the peripheral surface of the photosensitive member 51 after image transfer, toner remaining on the surface of the photosensitive member 51 and the like are removed by a cleaning member 58 typified by an elastic blade. The cleaned peripheral surface of the photosensitive member 51 proceeds to the next cycle of the electrophotographic image forming process.

According to one aspect of the present invention, the charging member capable of exhibiting stable charging performance over a long period of time can be obtained. In addition, according to another aspect of the present invention, the electrophotographic apparatus capable of stably forming a high-quality electrophotographic image over a long period of time can be obtained.

Now, the present invention is described in more detail by way of Examples. However, the present invention is not limited thereto. In the following description, for unspecified reagents and the like, commercially available high-purity products were used unless otherwise stated. In each example, a charging roller was produced.

Example 1

(Preparation of Unvulcanized Rubber Composition for Surface Layer)

Materials shown in Table 1 below were mixed to provide an A-kneaded rubber composition. A mixer used was a 6 L pressure kneader (product name: TD6-15MDX, manufactured by Toshin Co., Ltd.). Mixing conditions were set to a loading ratio of 70 vol %, a number of rotations of a blade of 30 rpm, and a mixing time of 16 minutes.

TABLE 1

| | |
|---|---|
| NBR (trade name: JSR N230SV, manufactured by JSR Corporation) | 100 parts by mass |
| Zinc stearate | 1 part by mass |
| Zinc oxide | 5 parts by mass |
| Calcium carbonate (trade name: Super #1700, manufactured by Maruo Calcium Co., Ltd.) | 20 parts by mass |
| Carbon black (trade name: TOKABLACK #7360SB, manufactured by Tokai Carbon Co., Ltd.) | 48 parts by mass |

Then, the A-kneaded rubber composition and materials shown in Table 2 were mixed to provide an unvulcanized rubber composition-1. A mixer used was an open roll having a roll diameter of 12 inches (0.30 m) (product name: 12×30 Test Roll, manufactured by Kansai Roll Co., Ltd.). Mixing conditions were as follows: bilateral cutting was performed a total of 20 times at a number of rotations of a front roll of 10 rpm, a number of rotations of a back roll of 8 rpm, and a roll gap of 2 mm, and then tight milling was performed 10 times at a roll gap of 0.5 mm. NOCCELER TBzTD is a vulcanization accelerator.

TABLE 2

| | |
|---|---|
| Sulfur | 1.2 parts by mass |
| Tetrabenzylthiuram disulfide (trade name: NOCCELER TBzTD, manufactured by Ouchi Shinko Chemical Industrial Co., Ltd.) | 4.5 parts by mass |

PU particles serving as elastic particles were produced by the following procedure. PU means polyurethane.

To 100 parts by mass of polydiethylene/butylene adipate having a hydroxyl value of 45, 12.5 parts by mass of a polyisocyanate of NCO %=12.3 (trade name: Duranate 24A, manufactured by Asahi Chemical Industry Co., Ltd.) was added, and the contents were uniformly mixed. The mixture was added to a dispersion liquid obtained by dispersing 5 parts by mass of fluorine-treated silica in 300 parts by mass of a fluorine oil (trade name: Galden HT135, manufactured by SOLVEY SA), and the resultant was subjected to ultrasonic treatment, for 20 minutes to provide an emulsified liquid. The temperature of the emulsified liquid was increased to 90° C., and stirred at 400 rpm for 8 hours to provide a dispersion liquid of polyurethane gel particles. The dispersion liquid was vacuum-dried to produce polyurethane particles (hereinafter sometimes referred to as "PU particles 4") having an average particle diameter of 15 μm, a hardness of 1.0 N/mm$^2$, and an elastic recovery power of 83%. The average particle diameter, the hardness, and the elastic recovery power of the elastic particles were measured by the methods described above. The measurement was performed in an environment having a temperature of 23° C. and a relative humidity of 50%.

Next, 20 parts by mass of the PU particles 4 were added to the unvulcanized rubber composition-1, and the contents were mixed to provide an unvulcanized rubber composition-1A containing the PU particles 4. A mixer used was an open roll having a roll diameter of 12 inches (0.30 m). Mixing conditions were as follows: bilateral cutting was performed a total of 20 times at a number of rotations of a front roll of 10 rpm, a number of rotations of a back roll of 8 rpm, and a roll gap of 2 mm, and then tight milling was performed 10 times at a roll gap of 0.5 mm.

(Measurement of Elongation at Break

The elongation at break of an unvulcanized rubber sheet was measured using a tensile tester. The unvulcanized rubber sheet was molded using the unvulcanized rubber composition 1A for a surface layer in a rectangular mold having a thickness of 2 mm. Molding conditions were set to a temperature of 80° C. and a pressure of 10 MPa. The measurement was performed using a Tensilon universal tester RTG-1225 (trade name, manufactured by Orientec Corporation) in conformity with JIS K-6251. In this case, the unvulcanized rubber sheet was cut into a test piece having a No. 1 dumbbell shape, a tension speed was set to 500 mm/min, and the measurement was performed under a 23° C./50% RH (relative humidity) environment. The elongation at break was 72%.

(Molding of Vulcanized Rubber Layer)

First, in order to obtain a mandrel having an adhesive layer for bonding a vulcanized rubber layer, the following operations were performed. That is, an electro-conductive vulcanized adhesive agent (trade name: METALOC U-20; manufactured by Toyokagaku Kenkyusho Co., Ltd.) was applied to a 222 mm central portion in the axis direction of a columnar electro-conductive mandrel having a diameter of 6 mm and a length of 252 mm (made of steel, having a nickel-plated surface), and was dried at 80° C. for 30 minutes.

The mandrel having an adhesive layer was covered with the unvulcanized rubber composition-1A for a surface layer through the use of a crosshead extrusion molding machine to provide an unvulcanized rubber roller having a crown shape. Molding was performed at a molding temperature of 100° C. and a number of rotations of a screw of 10 rpm while the feed rate of the mandrel was changed. A take-up ratio averaged in the axis direction of the unvulcanized rubber roller was set to 85%. The die inner diameter of the crosshead extrusion molding machine was Φ (diameter) 8.9 mm, the outer diameter of the unvulcanized rubber roller at the center in its axis direction was 8.6 mm, and the outer diameter of an end portion thereof was 8.4 mm.

After that, heating was performed in an electric furnace at a temperature of 160° C. for 40 minutes to vulcanize the layer of the unvulcanized rubber composition, and thus a vulcanized rubber layer was formed. Both end portions of the vulcanized rubber layer were cut to adjust its length in the axis direction to 232 mm.

(Electron Beam Irradiation of Vulcanized Rubber Layer after Extrusion))

The surface of the resultant vulcanized rubber roller after extrusion was irradiated with an electron beam, and thus a charging roller having a cured region in the surface of its elastic layer (surface layer) was obtained.

For the irradiation with an electron beam, an electron beam irradiation apparatus having a maximum accelerating voltage of 150 kV and a maximum electron current, of 40 mA (manufactured by Iwasaki Electric Co., Ltd.) was used, and nitrogen was charged at the time of the irradiation. The irradiation with an electron beam was performed under the conditions of an accelerating voltage of 150 kV, an electron current of 35 mA, a dose of 1,323 kGy, a treatment speed of 1 m/min, and an oxygen concentration of 100 ppm.

(Measurement of Surface Roughness)

The ten-point average roughness Rz of the surface of the elastic layer was measured. A measuring instrument used was a surface roughness measuring instrument (trade name: Surfcorder SE3400, manufactured by Kosaka Laboratory Ltd.), and a probe used was a contact needle made of diamond having a tip radius of 2 μm. The measurement was performed based on JIS B0601:1982 at a measurement speed of 0.5 mm/s, a cutoff frequency λc of 0.8 mm, a reference length of 0.8 mm, and an evaluation length of 8.0 mm. For the value of Rz of the charging roller, measurement was performed at a total of six points per charging roller, i.e., three points in an axis direction by two points in a circumferential direction, and the average value of the six points was used. As a result, the Rz was 22 μm.

(Observation of Elastic Particles)

The elastic particles on the surface of the charging roller were observed with a confocal microscope (trade name: OPTICS HYBRID, manufactured by Lasertec Corporation). Observation conditions were set to an objective lens magnification of 50, a number of pixels of 1,024 pixels, and a height resolution of 0.1 μm. The elastic particles were present in an exposed state.

(Measurement of Height of Convex Portions of Elastic Particles)

The height of the convex portions of the elastic particles was measured by the following method. First, a topographic image of the surface of the charging roller was measured with a confocal microscope (trade name: OPTICS HYBRID, manufactured by Lasertec Corporation). Observation conditions were set to an objective lens magnification of 50, a number of pixels of 1,024 pixels, and a height resolution of 0.1 μm, and a value obtained by subjecting the acquired image to plane correction with a quadric surface was defined as the value of the height.

From the topographic image, a cross-sectional profile of a peripheral portion of a gap formed in the periphery of each of the convex portions of the elastic particles was extracted, and a distance from the average line of the height to the apex of each of the convex portions was determined. Values at 100 points (100 convex portions) were averaged, and the average value was defined as the height of the convex portions. The height of the convex portions was 6 μm.

(Measurement of Gap Portion Distance)

The gap portion distance refers to the length of the longest line segment out of line segments formed by straight lines drawn from the outer edge of the elastic particle in a normal direction and points of intersection between the straight lines and the outer edge of the concave portion, in a projection view of a surface from a point of view in a normal direction with respect to the surface. The gap portion distance was measured by the following method. First, a topographic image of the surface of the charging roller was measured with a confocal microscope (trade name: OPTICS HYBRID, manufactured by Lasertec Corporation). Observation conditions were set to an objective lens magnification of 50, a number of pixels of 1,024 pixels, and a height resolution of 0.1 μm, and a value obtained by subjecting the acquired image to plane correction with a quadric surface was defined as the value of the height.

Subsequently, the gap portion distance was calculated using image processing software (trade name: "Image-Pro Plus": manufactured by Planetron, Inc.). First, the average value of the height was used as a threshold value, and the topographic image was binarized. Next, an object at a portion lower than the average value of the height, was automatically extracted by Count/Size. A normal was drawn from the outer edge of an elastic particle in contact with the object, and the distance of a portion at the longest distance from the outer edge of the concave portion was calculated. For objects at portions lower than the average value of the extracted heights, in the order of decreasing area, such operation was performed at 100 points in the vicinity of the center in the axis direction of the roller and 100 points in the vicinity of 20 mm from an end portion of the vulcanized rubber layer, and an average value was extracted. The average value was defined as the gap portion distance. When the distance is ⅓ or more of the average particle diameter and 70 μm or less, the effect of the present invention can be excellently exhibited. The gap portion distance was 40 μm.

(Measurement of Orientation of Position of Center of Gravity of Gap Formed by Separation of Elastic Particle and Concave Portion and Position of Center of Gravity of Elastic Particle)

In order to measure the orientation of the position of the center of gravity of a gap formed by separation of an elastic particle and a concave portion and the position of the center of gravity of the particle, an image was acquired with a transmission electron microscope (hereinafter abbreviated as "TEM"). As a sample to be observed with the TEM, a thin section obtained by cutting the surface layer so as to cut the concave portion along the average plane of the height of the surface shape was used. The thin section was prepared by an ultra-thin sectioning method. A cutting apparatus used was a cryomicrotome (trade name: "Leica EM FCS", manufactured by Leica Microsystems). A cutting temperature was set to −100° C. The TEM used for observation of the cut section was H-7100FA (trade name) manufactured by Hitachi High-Technologies Corporation. An accelerating voltage was set to 100 kV, and a field of view was set to a bright field. An image obtained by observing the thin section with the TEM was taken so that there was a contrast difference in each of the concave portion (void), the elastic particle, and the electro-conductive rubber composition. As required, an image obtained by image processing to ternarize the concave portion (void), the elastic particle, and the electro-conductive rubber composition was used.

The X-coordinate of the center of gravity of each concave portion in the image and the Y-coordinate of the center of gravity thereof, and the X-coordinate of the center of gravity of the elastic particle present in the concave portion and the Y-coordinate of the center of gravity thereof were measured by the Count/Size function of image processing software (trade name: "Image-Pro Plus": manufactured by Planetron, Inc.). An acute angle formed by a direction connecting the coordinates of the two points and the axis direction of the roller was measured at 100 points (100 concave portions), and the average value thereof was defined as the orientation angle of the position of the center of gravity of the gap formed by separation of the elastic particle and the concave portion and the position of the center of gravity of the elastic particle. The orientation angle was 6°.

In addition, the Martens hardness of the elastic particles, and the Martens hardness of the elastic material forming the gap-forming concave portion wall were measured by the methods described above. For the above-mentioned matters, the details of the charging roller of Example 1 are shown in Table 4.

(Evaluation 1) Evaluation of Toner Contamination

The produced charging roller was mounted onto a black cartridge of a modified machine obtained by modifying an electrophotographic apparatus (trade name: LBP7200C, manufactured by Canon Inc., for A4 paper lengthwise output) so as to have an output speed of a recording medium of 200 mm/sec. In addition, in this case, onto the black cartridge, a cleaner blade having an international rubber hardness of 65° was mounted to reduce the abutting pressure of the cleaner blade against the photosensitive member to allow easy passage of toner. Image output was performed with the modified machine under a 15° C./10% RH environment.

Image output conditions were as follows: an image randomly printed on 1 area % of the image forming region of A4 paper was used, and an operation involving stopping the electrophotographic apparatus after the output of the image on one sheet, and 10 seconds after that, resuming the image forming operation again was repeated to perform a 30,000-sheet image output endurance test.

Then, spot-like image unevenness was evaluated based on the following criteria.

A: There was no spot-like image unevenness contamination.

B: There was such slight spot-like image unevenness as not to cause any problem in practical use.

C: There was spot-like image unevenness.

D: There was remarkable spot-like image unevenness.

In the surface layer of Example 1, the Martens hardnesses of the convex portions and the gap-forming concave portion wall, and the surface shape including the height of the convex portions, the gap portion distance, the orientation of the gap, and the Rz were proper. Accordingly, the spot-like image unevenness was evaluated as A.

(Evaluation 2) Evaluation of Stepped Unevenness-Like Image Unevenness

The produced charging roller was mounted onto a black cartridge of a modified machine obtained by modifying an electrophotographic apparatus (trade name: LBP7200C, manufactured by Canon Inc., for A4 paper lengthwise output) so as to have an output speed of a recording medium of 200 mm/sec. In addition, in this case, onto the black cartridge, a cleaner blade having an international rubber hardness of 71° was mounted to increase the abutting pressure of the cleaner blade against the photosensitive member to allow easy passage of only an external additive. Image output was performed with the modified machine under a 15° C./10% RH environment.

Image output conditions were as follows: an image randomly printed on 1 area % of the image forming region of A4 paper was used, and an operation involving stopping the electrophotographic apparatus after the output of the image on one sheet, and 10 seconds after that, resuming the image forming operation again was repeated to perform a 30,000-sheet image output endurance test.

Then, stepped unevenness-like image unevenness was evaluated based on the following criteria.

A: There was no stepped unevenness-like image unevenness.

B: There was such slight stepped unevenness-like image unevenness as not to cause any problem in practical use.

C: There was stepped unevenness-like image unevenness.

D: There was remarkable stepped unevenness-like image unevenness.

In the surface layer of Example 1, the Martens hardnesses of the convex portions and the gap-forming conceive portion wall, and the surface shape including the height of the convex portions, the gap portion distance, the orientation of the gap, and the Rz were proper. Accordingly, the stepped unevenness-like image unevenness was evaluated as A.

(Evaluation 3) Evaluation of Charging Uniformity

The produced charging roller was mounted onto a black cartridge of a modified machine obtained by modifying an electrophotographic apparatus (trade name: LBP7200C, manufactured by Canon Inc., for A4 paper lengthwise output) so as to have an output speed of a recording medium of 200 mm/sec. In addition, in this case, onto the cartridge, a cleaner blade having an international rubber hardness of 71° was mounted. Image output was performed with the modified machine under a 15° C./10% RH environment.

Image output conditions were as follows: an image randomly printed on 1 area % of the image forming region of A4 paper was used, and an operation involving stopping the electrophotographic apparatus after the output of the image on one sheet, and 10 seconds after that, resuming the image forming operation again was repeated to perform a 30,000-sheet image output endurance test. Output conditions for an image for evaluation after 30,000-sheet endurance were as follows: a halftone image (intermediate-density image in which horizontal lines each having a width of 1 dot were drawn at an interval of 2 dots in a direction perpendicular to the rotation direction of the photosensitive member) was output on one sheet. With the use of this image, horizontal streak-like image unevenness was evaluated based on the following criteria.

A: There was no horizontal streak-like image unevenness.

B: There was such slight horizontal streak-like image unevenness as not to cause any problem in practical use.

C: There was horizontal streak-like image unevenness over a wide region of the image, markedly impairing image quality.

In the surface layer of Example 1, the Martens hardnesses of the convex portions and the gap-forming concave portion wall, and the surface shape including the height of the convex portions, the gap portion distance, the orientation of the gap, and the Rz were proper. Accordingly, the horizontal streak-like image unevenness was evaluated as A, and high image quality was kept.

Example 2

PU particles 2 serving as elastic particles having an average particle diameter of 15 μm, a Martens hardness of 3.0 N/mm$^2$, and an elastic recovery power of 83% were produced in the same manner as in Example 1 except that the NCO % of the polyisocyanate was changed from 12.3 to 34.9. A charging roller was produced by the same operations as those of Example 1 except that those particles were used and the take-up ratio at the time of the extrusion molding was changed from 85% to 83%, and the roller was subjected to the same evaluations. As a result, the spot-like image unevenness was evaluated as B, the stepped unevenness-like image unevenness was evaluated as A, and the horizontal streak-like image unevenness was evaluated as A.

Example 3

PU particles 3 serving as elastic particles having an average particle diameter of 15 μm, a Martens hardness of 2.0 N/mm$^2$, and an elastic recovery power of 84% were produced in the same manner as in Example 1 except that the NCO % of the polyisocyanate was changed from 12.3 to 24.6. A charging roller was produced by the same operations as those of Example 1 except that those particles were used and the take-up ratio at the time of the extrusion molding was changed from 85% to 82%, and the roller was subjected to the same evaluations. As a result, the spot-like image unevenness was evaluated as A, the stepped unevenness-like image unevenness was evaluated as A, and the horizontal streak-like image unevenness was evaluated as A.

Example 4

PU particles 5 serving as elastic particles having an average particle diameter of 15 μm, a Martens hardness of 0.1 N/mm$^2$, and an elastic recovery power of 85% were produced in the same manner as in Example 1 except that the NCO % of the polyisocyanate was changed from 12.3 to 3.7. A charging roller was produced by the same operations as those of Example 1 except that those particles were used and the take-up ratio at the time of the extrusion molding was changed from 85% to 86%, and the roller was subjected to the same evaluations. As a result, the spot-like image unevenness was evaluated as A, the stepped unevenness-like image unevenness was evaluated as B, and the horizontal streak-like image unevenness was evaluated as A.

Example 5

80 Parts by mass of N230SV and 20 parts by mass of NBR (trade name: JSR N230SL, manufactured by JSR Corporation) were added in place of the addition of 100 parts by mass of N230SV. In addition, in the electron beam irradiation of the vulcanized rubber layer, the electron current was changed from 35.0 mA to 19.0 mA. Except for the foregoing, a charging roller was produced by the same operations as those of Example 1, and the roller was subjected to the same evaluations. As a result, the spot-like image unevenness was evaluated as A, the stepped unevenness-like image unevenness was evaluated as A, and the horizontal streak-like image unevenness was evaluated as A.

Example 6

85 Parts by mass of "N230SV" and 15 parts by mass of "N230SL" were added in place of the addition of 100 parts by mass of N230SV. In addition, in the electron beam irradiation of the vulcanized rubber layer, the electron current was changed from 35.0 mA to 21.0 mA, and the take-up ratio was changed from 85% to 86%. Except for the foregoing, a charging roller was produced by the same operations as those of Example 1, and the roller was subjected to the same evaluations.

As a result, the spot-like image unevenness was evaluated as B, the stepped unevenness-like image unevenness was evaluated as A, and the horizontal streak-like image unevenness was evaluated as A.

Example 7

75 Parts by mass of "N230SV" and 25 parts by mass of NBR (trade name: Nipol DN219, manufactured by Zeon Corporation) were added in place of the addition of 100 parts by mass of N230SV. In addition, in the electron beam irradiation of the vulcanized rubber layer, the electron current was changed from 35.0 mA to 20.0 mA, and the take-up ratio was changed from 85% to 83%. Except for the foregoing, a charging roller was produced by the same operations as those of Example 1, and the roller was subjected to the same evaluations. As a result, the spot-like image unevenness was evaluated as A, the stepped unevenness-like image unevenness was evaluated as B, and the horizontal streak-like image unevenness was evaluated as A.

Example 8

PU particles 7 serving as elastic particles having an average particle diameter of 4 μm, a Martens hardness of 1.0 N/mm$^2$, and an elastic recovery power of 83% were produced in the same manner as in Example 1 except that the addition amount of the polyisocyanate was changed from 12.5 parts by mass to 3 parts by mass. A charging roller was produced by the same operations as those of Example 1 except that those particles were used and the take-up ratio at the time of the extrusion molding was changed from 85% to 88%, and the roller was subjected to the same evaluations. As a result, the spot-like image unevenness was evaluated as A, the stepped unevenness-like image unevenness was evaluated as A, and the horizontal streak-like image unevenness was evaluated as B.

Example 9

PU particles 8 serving as elastic particles having an average particle diameter of 6 μm, a Martens hardness of 1.0 N/mm$^2$, and an elastic recovery power of 84% were produced in the same manner as in Example 1 except that the addition amount of the polyisocyanate was changed from 12.5 parts by mass to 5 parts by mass. A charging roller was produced by the same operations as those of Example 1 except that those particles were used and the take-up ratio at the time of the extrusion molding was changed from 85% to 86%, and the roller was subjected to the same evaluations. As a result, the spot-like image unevenness was evaluated as A, the stepped unevenness-like image unevenness was evaluated as A, and the horizontal streak-like image unevenness was evaluated as A.

Example 10

PU particles 9 serving as elastic particles having an average particle diameter of 30 μm, a Martens hardness of 1.0 N/mm$^2$, and an elastic recovery power of 85% were produced in the same manner as in Example 1 except that the addition amount of the polyisocyanate was changed from 12.5 parts by mass to 23 parts by mass. A charging roller was produced by the same operations as those of Example 1 except that those particles were used and the take-up ratio at the time of the extrusion molding was changed from 85% to 81%, and the roller was subjected to the same evaluations. As a result, the spot-like image unevenness was evaluated as A, the stepped unevenness-like image unevenness was evaluated as A, and the horizontal streak-like image unevenness was evaluated as A.

Example 11

PU particles 10 serving as elastic particles having an average particle diameter of 31 μm, a Martens hardness of 1.0 N/mm$^2$, and an elastic recovery power of 85% were produced in the same manner as in Example 1 except that the addition amount of the polyisocyanate was changed from 12.5 parts by mass to 26 parts by mass. A charging roller was produced by the same operations as those of Example 1 except that those particles were used and the take-up ratio at the time of the extrusion molding was changed from 85% to 80%, and the roller was subjected to the same evaluations. As a result, the spot-like image unevenness was evaluated as B, the stepped unevenness-like image unevenness was evaluated as A, and the horizontal streak-like image unevenness was evaluated as A.

Comparative Example 1

A charging roller was produced by the same operations as those of Example 1 except that no particles were added and the take-up ratio at the time of the extrusion molding was changed from 85% to 90%, and the roller was subjected to the same evaluations. As a result, the spot-like image unevenness was evaluated as D, the stepped unevenness-like image unevenness was evaluated as C, and the horizontal streak-like image unevenness was evaluated as D.

Comparative Example 2

70 Parts by mass of "N230SV" and 30 parts by mass of "DN219" were added in place of the addition of 100 parts by mass of N230SV. In addition, the take-up ratio was changed from 85% to 98%. Except for the foregoing, a charging roller was produced by the same operations as those of Example 1, and the roller was subjected to the same evaluations. As a result, the spot-like image unevenness was evaluated as D, the stepped unevenness-like image unevenness was evaluated as C, and the horizontal streak-like image unevenness was evaluated as C.

Comparative Example 3

PU particles 6 serving as elastic particles having an average particle diameter of 15 μm, a Martens hardness of 0.09 $N/mm^2$, and an elastic recovery power of 85% were produced in the same manner as in Example 1 except that the NCO % of the polyisocyanate was changed from 12.3 to 2.0. A charging roller was produced by the same operations as those of Example 1 except that those particles were used and the take-up ratio at the time of the extrusion molding was changed from 85% to 90%, and the roller was subjected to the same evaluations. As a result, the spot-life image unevenness was evaluated as A, the stepped unevenness-like image unevenness was evaluated as D, and the horizontal streak-like image unevenness was evaluated as B.

Comparative Example 4

PU particles 1 serving as elastic particles having an average particle diameter of 15 μm, a Martens hardness of 4.0 $N/mm^2$, and an elastic recovery power of 84% were produced in the same manner as in Example 1 except that the NCO % of the polyisocyanate was changed from 12.3 to 49.2. A charging roller was produced by the same operations as those of Example 1 except that those particles were used and the take-up ratio at the time of the extrusion molding was changed from 85% to 84%, and the roller was subjected to the same evaluations. As a result, the spot-like image unevenness was evaluated as D, the stepped unevenness-like image unevenness was evaluated as B, and the horizontal streak-like image unevenness was evaluated as A.

Example 12

75 Parts by mass of "N230SV" and 25 parts by mass of "DN219" were added in place of the addition of 100 parts by mass of N230SV. In addition, in the electron beam irradiation of the vulcanized rubber layer, the electron current was changed from 35.0 mA to 25.0 mA, and the take-up ratio was changed from 85% to 83%. Except for the foregoing, a charging roller was produced by the same operations as those of Example 1, and the roller was subjected to the same evaluations. As a result, on the surface of the roller, the spot-like image unevenness was evaluated as A, the stepped unevenness-like image unevenness was evaluated as A, and the horizontal streak-like image unevenness was evaluated as A.

Example 13

A charging roller was produced by the same operations as those of Example 1 except that 95 parts by mass of "N230SV" and 5 parts by mass of "N230SL" were added in place of the addition of 100 parts by mass of N230SV, and the take-up ratio was changed from 85% to 92%, and the roller was subjected to the same evaluations. As a result, the spot-like image unevenness was evaluated as B, the stepped unevenness-like image unevenness was evaluated as A, and the horizontal streak-like image unevenness was evaluated as A.

Example 14

A charging roller was produced by the same operations as those of Example 1 except that 90 parts by mass of "N230SV" and 10 parts by mass of "N230SL" were added in place of the addition of 100 parts by mass of N230SV, and the take-up ratio was changed from 85% to 91%, and the roller was subjected to the same evaluations. As a result, the spot-like image unevenness was evaluated as A, the stepped unevenness-like image unevenness was evaluated as A, and the horizontal streak-like image unevenness was evaluated as A.

Example 15

A charging roller was produced by the same operations as those of Example 1 except that 85 parts by mass of "N230SV" and 15 parts by mass of "N230SL" were added in place of the addition of 100 parts by mass of N230SV, and the take-up ratio was changed from 85% to 80%, and the roller was subjected to the same evaluations. As a result, the elongation at break of the unvulcanized rubber sheet was 80%. In addition, the spot-like image unevenness was evaluated as A, the stepped unevenness-like image unevenness was evaluated as A, and the horizontal streak-like image unevenness was evaluated as A.

Example 16

80 Parts by mass of "N230SV" and 20 parts by mass of "N230SL" were added in place of the addition of 100 parts by mass of N230SV. In addition, in the electron beam irradiation of the vulcanized rubber layer, the electron current was changed from 35.0 mA to 30.0 mA, and the take-up ratio was changed from 85% to 78%. Except for the foregoing, a charging roller was produced by the same operations as those of Example 1, and the roller was subjected to the same evaluations. As a result, the spot-like image unevenness was evaluated as B, the stepped unevenness-like image unevenness was evaluated as A, and the horizontal streak-like image unevenness was evaluated as A.

Example 17

75 Parts by mass of "N230SV" and 25 parts by mass of "N230SL" were added in place of the addition of 100 parts by mass of N230SV. In addition, in the electron beam irradiation of the vulcanized rubber layer, the electron current was changed from 35.0 mA to 25.0 mA, and the take-up ratio was changed from 85% to 72%. Except for the foregoing, a charging roller was produced by the same operations as those of Example 1, and the roller was subjected to the same evaluations. As a result, the spot-like image unevenness was evaluated as B, the stepped unevenness-like image unevenness was evaluated as A, and the horizontal streak-like image unevenness was evaluated as A.

Example 18

100 Parts by mass of methyl methacrylate, 0.1 part by mass of divinylbenzene, 0.1 part by mass of benzoyl peroxide, 10 parts by mass of hydroxyapatite, and 120 parts by mass of water were added to a 1 mass % aqueous solution of sodium dodecylbenzenesulfonate, and the contents were mixed. The resultant liquid was subjected to ultrasonic treatment for 20 minutes to provide an emulsified liquid. The temperature of the emulsified liquid was increased to 80° C., followed by stirring at 400 rpm for 8 hours. The resultant dispersion liquid of PMMA particles was vacuum-dried to produce PMMA particles 1 serving as elastic particles having an average particle diameter of 15 μm, a Martens hardness of 1.0 N/mm$^2$, and an elastic recovery power of 74%. PMMA represents polymethyl methacrylate resin. A charging roller was produced by the same operations as those of Example 1 except that those particles were used and the take-up ratio at the time of the extrusion molding was changed from 85% to 83%, and the roller was subjected to the same evaluations. As a result, the spot-like image unevenness was evaluated as A, the stepped unevenness-like image unevenness was evaluated as A, and the horizontal streak-like image unevenness was evaluated as A.

Comparative Example 5

PMMA particles 2 serving as elastic particles having an average particle diameter of 15 μm, a Martens hardness of 30.0 N/mm$^2$, and an elastic recovery power of 71% were produced in the same manner as in Example 18 except that the addition amount of the benzoyl peroxide was changed from 0.1 part by mass to 3.0 parts by mass. A charging roller was produced by the same operations as those of Example 1 except that those particles were used and the take-up ratio at the time of the extrusion molding was changed from 85% to 81%, and the roller was subjected to the same evaluations. As a result, the spot-like image unevenness was evaluated as C, the stepped unevenness-like image unevenness was evaluated as B, and the horizontal streak-like image unevenness was evaluated as A.

Example 19

In order to obtain silicone particles, the following operations were performed. 600 g of methylvinylpolysiloxane having a kinematic viscosity of 600 mm$^2$/s, and 24 g of methylhydrogenpolysiloxane having a kinematic viscosity of 30 mm$^2$/s (such a blending amount that the number of hydroxyl groups was 0.90 per olefinically unsaturated group) were dissolved. For this purpose, those components were stirred at 2,000 rpm using a homomixer. Then, 6 g of polyoxyethylene octyl phenyl ether and 180 g of water were added, and the mixture was stirred at 5,000 rpm. After the confirmation of a viscosity increase, stirring was further continued for 10 minutes. Then, while the mixture was stirred at 2,000 rpm, 400 g of water was added to provide an emulsified liquid. The emulsified liquid was transferred to a glass flask, and the temperature was controlled to 20° C. After that, under stirring, a mixed solution of 1 g of polyoxyethylene octyl phenyl ether was added, and the whole was stirred at the same temperature for 12 hours to provide an aqueous dispersion liquid of silicone elastomer fine particles. To 700 g of the dispersion liquid, 2,500 g of water, 70 g of 28 mass % ammonia water, and 4 g of a 40 mass % dimethyldiallylammonium chloride polymerized aqueous solution (trade name: ME Polymer H40W, manufactured by Toho Chemical Industry Co., Ltd.) were added. The temperature was controlled to 10° C., and then 400 g of methyltrimethoxysilane was added over 20 minutes. The mixture was further stirred for 1 hour. After that, the mixture was heated to 60° C. and stirred for 1 hour to complete hydrolysis and condensation reactions. The solution was dehydrated to remove about 30% of its water content using a pressure filter. Water was added to the dehydrated product and the resultant was dehydrated again, followed by drying at a temperature of 105° C. Thus, silicone particles 1 serving as elastic particles having an average particle diameter of 15 μm, a Martens hardness of 1.0 N/mm$^2$, and an elastic recovery power of 78% were produced. A charging roller was produced by the same operations as those of Example 1 except that those particles were used and the take-up ratio at the time of the extrusion molding was changed from 85% to 84%, and the roller was subjected to the same evaluations. As a result, the spot-like image unevenness was evaluated as A, the stepped unevenness-like image unevenness was evaluated as A, and the horizontal streak-like image unevenness was evaluated as A.

Comparative Example 6

Silicone particles 2 serving as elastic particles having an average particle diameter of 15 μm, a Martens hardness of 50.0 N/mm$^2$, and an elastic recovery power of 75% were produced in the same manner as in Example 19 except that the addition amount of methyltrimethoxysilane was changed to 80 g. A charging roller was produced by the same operations as those of Example 1 except that those particles were used and the take-up ratio at the time of the extrusion molding was changed from 85% to 84%, and the roller was subjected to the same evaluations. As a result, the spot-like image unevenness was evaluated as D, the stepped unevenness-like image unevenness was evaluated as C, and the horizontal streak-like image unevenness was evaluated as A.

Comparative Example 7

A charging roller was produced by the same operations as those of Example 2 except that the electron current was changed from 35 mA to 4.7 mA, and the roller was subjected to the same evaluations. As a result, the spot-like image unevenness was evaluated as B, the stepped unevenness-like image unevenness was evaluated as D, and the horizontal streak-like image unevenness was evaluated as A.

Comparative Example 8

85 Parts by mass of "N230SV" and 15 parts by mass of "N230SL" were added in place of the addition of 100 parts by mass of "N230SV". In addition, the elastic particles were changed to the silicone particles 2, and the take-up ratio at the time of the extrusion molding was changed from 84% to 87%. Except for the foregoing, a vulcanized rubber roller was produced by the same operations as those of Comparative Example 4. Then, a covering layer was formed on the surface of the vulcanized rubber roller to produce a charging roller, and the charging roller was subjected to the same measurement and evaluations as those of Example 1. The covering layer was formed by the following procedure.

Materials shown in Table 3 were mixed to prepare a mixed liquid.

TABLE 3

| | |
|---|---|
| Polyol | 100 parts by mass |
| TPDI | 22.5 parts by mass |
| HDI | 33.6 parts by mass |
| Carbon black | 30 parts by mass (corresponding to 10 vol %) |
| Methyl isobutyl ketone (MIBK) | 500 parts by mass |

The polyol refers to a polyol (trade name: "PLACCEL DC2016": manufactured by Daicel Chemical Industries, Ltd.) (solid content: 70 mass %) to serve as a binder of the covering layer. The IPDI (isophorone diisocyanate) refers to a blocked isocyanate IPDI (trade name: "VESTANAT B1370": manufactured by Degussa-Huels AG) to be added as an isocyanate monomer to serve as a binder of the covering layer.

The HDI (hexamethylene diisocyanate) refers to a blocked isocyanate HDI (trade name: "Duranate TPA-B80E": manufactured by Asahi Chemical Industry Co., Ltd.) to be added as an isocyanate monomer to serve as a binder of the covering layer. The carbon black serves as electro-conductive particles.

The mixed liquid and glass beads having an average particle diameter of 0.8 mm were loaded together into a glass bottle, and dispersed for 60 hours using a paint shaker dispersing machine to prepare a paint 1 for a covering layer. Then, the molded vulcanized rubber roller was coated with the paint 1 for a covering layer by dipping. After that, the resultant was air-dried at ordinary temperature for 30 minutes or more, and heated at 160° C. for 1 hour to provide a charging roller of Comparative Example 8. Its film thickness was 2.0 μm.

The roller was subjected to the evaluations. As a result, the spot-like contamination unevenness was evaluated as D, the stepped unevenness-like contamination unevenness was evaluated as D, and the horizontal streak-like image unevenness was evaluated as A.

Example 20

The same unvulcanized rubber composition-1 as that of Example 1 (NBR being set to 100 parts by mass), and 5 parts by mass of sodium hydrogen carbonate (trade name: Cellmic 266, manufactured by Sankyo Kasei Co., Ltd.) serving as a foaming agent were mixed to provide an unvulcanized rubber composition-2 containing the foaming agent. A mixer used was an open roll having a roll diameter of 12 inches (0.30 m). Mixing conditions were as follows: bilateral cutting was performed a total of 20 times at a number of rotations of a front roll of 10 rpm, a number of rotations of a back roll of 8 rpm, and a roll gap of 2 mm, and then tight milling was performed 10 times at a roll gap of 0.5 mm.

(Molding of Vulcanized Rubber Layer)

First, in order to obtain a mandrel having an adhesive layer for bonding a vulcanized rubber layer, the following operations were performed. That is, an electro-conductive vulcanized adhesive agent (trade name: METALOC U-20; manufactured by Toyokagaku Kenkyusho Co., Ltd.) was applied to a 222 mm central portion in the axis direction of a columnar electro-conductive mandrel having a diameter of 6 mm and a length of 252 mm (made of steel, having a nickel-plated surface), and was dried at 80° C. for 30 minutes.

The mandrel having an adhesive layer was covered with the unvulcanized rubber composition-2 for a surface layer through the use of a crosshead extrusion molding machine to provide a non-crown-shaped unvulcanized rubber roller. Molding was performed at a molding temperature of 100° C., a number of rotations of a screw of 10 rpm, and a constant feed rate of the mandrel. A take-up ratio averaged in the axis direction of the unvulcanized rubber roller was set to 103%. The die inner diameter of the crosshead extrusion molding machine was Φ9.0 mm, the outer diameter of the unvulcanized rubber roller at the center in its axis direction was 9.1 mm, and the outer diameter of an end portion thereof was 9.1 mm.

After that, in the same manner as in (Molding of Vulcanized Rubber Layer) of Example 1, heating was performed in an electric furnace at a temperature of 160° C. for 40 minutes to vulcanize the layer of the unvulcanized rubber composition, and thus a vulcanized rubber layer was formed. Both end portions of the vulcanized rubber layer were cut off to adjust its length in the axis direction to 232 mm. Subsequently, the surface of the vulcanized rubber layer was ground with a grinder of a plunge cut grinding system into a crown shape having an end portion diameter of 8.4 mm and a central portion diameter of 8.6 mm. Thus, a vulcanized rubber roller having a vulcanized rubber layer having formed in its surface concave portions resulting from voids formed by foaming of the foaming agent was obtained.

A 0.1 mass % aqueous dispersion liquid of the PU particles 8 was prepared. The vulcanized rubber roller was dipped in the aqueous dispersion liquid, and then the vulcanized rubber roller was pulled up at a speed of 50 mm/second and air-dried to evaporate water. Thus, the elastic material resin particles were applied to the vulcanized rubber layer. The resultant was heated in an electric furnace at a temperature of 180° C. for 15 minutes to melt the PU particles 8, and thus the PU particles 8 were fused with the surface of the vulcanized rubber roller. Subsequently, the mandrel was held at both end portions of the vulcanized rubber roller, and the vulcanized rubber roller was ground, while being rotated at 60 rpm, by bringing a wrapping film (trade name: 3M Wrapping Film Sheet #4000, manufactured by 3M Company) into pressure contact therewith, to thereby remove the PU particles 8 serving as elastic particles that adhered to portions other than the concave portions. Thus, a charging roller of Example 20 was obtained. The roller was subjected to the same evaluations as those of Example 1. As a result, the spot-like image unevenness was evaluated as B, the stepped unevenness-like image unevenness was evaluated as A, and the horizontal streak-like image unevenness was evaluated as B.

Comparative Example 9

PU particles 11 serving as elastic particles having a diameter of 15 μm, a hardness of 1.0 N/mm$^2$, and an elastic recovery rate of 69% were produced in the same manner as in Example 1 except that the temperature increase of the emulsified liquid was changed from 90° C. to 85° C. A charging roller was produced by the same operations as those of Example 1 except that those particles were used and the take-up ratio at the time of the extrusion molding was changed from 85% to 84%, and the roller was subjected to the same evaluations. As a result, the spot-like image unevenness was evaluated as C, the stepped unevenness-like image unevenness was evaluated as A, and the horizontal streak was evaluated as A.

The material formulations and processing conditions of the charging rollers according to Examples 1 to 20 and Comparative Examples 1 to 9 are shown in Table 4-1 and Table 4-2.

In addition, the details and evaluation results of the charging rollers of Examples 1 to 20 and Comparative Examples 1 to 9 are shown in Table 5-1 and Table 5-2. In the case of further forming the covering layer on the surface layer (Comparative Example 8), the Martens hardnesses of the rubber matrix (elastic material forming the gap) and the elastic particles were evaluated from above the covering layer. In addition, the stats of the elastic particles, the gap portion distance, the Rz, and the orientation degree of the convex portion and the gap were evaluated after the covering. In addition, the sphericities (shape coefficients SF1) of the elastic particles used in Examples 1 to 20 and Comparative Examples 2 to 9 were all 100 or more and 160 or less.

In addition, the physical properties of the elastic particles used in Examples and Comparative Examples are collectively shown in Table 6.

TABLE 4-1

| | Example | | | | | | | | | | | Comparative Example | | | |
|---|---|---|---|---|---|---|---|---|---|---|---|---|---|---|---|
| | 1 | 2 | 3 | 4 | 5 | 6 | 7 | 8 | 9 | 10 | 11 | 1 | 2 | 3 | 4 |
| Blending material [part(s) by mass] | | | | | | | | | | | | | | | |
| NBR (N230SV) | 100 | 100 | 100 | 100 | 80 | 85 | 75 | 100 | 100 | 100 | 100 | 100 | 70 | 100 | 100 |
| NBR (N230SL) | | | | | 20 | 15 | | | | | | | | | |
| NBR (DN219) | | | | | | | 25 | | | | | | 30 | | |
| Carbon black | 48 | 48 | 48 | 48 | 48 | 48 | 48 | 48 | 48 | 48 | 48 | 48 | 48 | 48 | 48 |
| Zinc oxide | 5 | 5 | 5 | 5 | 5 | 5 | 5 | 5 | 5 | 5 | 5 | 5 | 5 | 5 | 5 |
| Zinc stearate | 1 | 1 | 1 | 1 | 1 | 1 | 1 | 1 | 1 | 1 | 1 | 1 | 1 | 1 | 1 |
| Calcium carbonate | 20 | 20 | 20 | 20 | 20 | 20 | 20 | 20 | 20 | 20 | 20 | 20 | 20 | 20 | 20 |
| Sodium hydrogen carbonate | | | | | | | | | | | | | | | |
| Sulfur | 1.2 | 1.2 | 1.2 | 1.2 | 1.2 | 1.2 | 1.2 | 1.2 | 1.2 | 1.2 | 1.2 | 1.2 | 1.2 | 1.2 | 1.2 |
| NOCCELER TBzTD | 4.5 | 4.5 | 4.5 | 4.5 | 4.5 | 4.5 | 4.5 | 4.5 | 4.5 | 4.5 | 4.5 | 4.5 | 4.5 | 4.5 | 4.5 |
| PU particles 1 | | | | | | | | | | | | | | | 20 |
| PU particles 2 | | 20 | | | | | | | | | | | | | |
| PU particles 3 | | | 20 | | | | | | | | | | | | |
| PU particles 4 | 20 | | | | 20 | 20 | 20 | | | | | | 20 | | |
| PU particles 5 | | | | 20 | | | | | | | | | | | |
| PU particles 6 | | | | | | | | | | | | | | 20 | |
| PU particles 7 | | | | | | | | 20 | | | | | | | |
| PU particles 8 | | | | | | | | | 20 | | | | | | |
| PU particles 9 | | | | | | | | | | 20 | | | | | |
| PU particles 10 | | | | | | | | | | | 20 | | | | |
| Processing condition | | | | | | | | | | | | | | | |
| Elongation at break [%] | 72 | 78 | 75 | 66 | 84 | 84 | 70 | 68 | 70 | 76 | 79 | 72 | 52 | 71 | 80 |
| Take-up ratio [%] | 85 | 83 | 82 | 86 | 85 | 85 | 83 | 88 | 86 | 81 | 80 | 90 | 98 | 90 | 84 |
| Electron current in electron beam irradiation [mA] | 35.0 | 35.0 | 35.0 | 35.0 | 19.0 | 21.0 | 20.0 | 35.0 | 35.0 | 35.0 | 35.0 | 35.0 | 35.0 | 35.0 | 35.0 |

TABLE 4-2

| | Example | | | | | | | Comparative Example 5 | Example | Comparative Example | | | Example | Comparative Example 9 |
|---|---|---|---|---|---|---|---|---|---|---|---|---|---|---|
| | 12 | 13 | 14 | 15 | 16 | 17 | 18 | | 19 | 6 | 7 | 8 | 20 | |
| Blending material [part(s) by mass] | | | | | | | | | | | | | | |
| NBR (N230SV) | 75 | 95 | 90 | 85 | 80 | 75 | 100 | 100 | 100 | 100 | 100 | 86 | 100 | 100 |
| NBR (N230SL) | | 5 | 10 | 15 | 20 | 25 | | | | | | 15 | | |
| NBR (DN219) | 25 | | | | | | | | | | | | | |
| Carbon black | 48 | 48 | 48 | 48 | 48 | 48 | 48 | 48 | 48 | 48 | 48 | 48 | 48 | 48 |
| Zinc oxide | 5 | 5 | 5 | 5 | 5 | 5 | 5 | 5 | 5 | 5 | 5 | 5 | 5 | |
| Zinc stearate | 1 | 1 | 1 | 1 | 1 | 1 | 1 | 1 | 1 | 1 | 1 | 1 | 1 | 1 |
| Calcium carbonate | 20 | 20 | 20 | 20 | 20 | 20 | 20 | 20 | 20 | 20 | 20 | 20 | 20 | 20 |
| Sodium hydrogen carbonate | | | | | | | | | | | | | 5 | |
| Sulfur | 1.2 | 1.2 | 1.2 | 1.2 | 1.2 | 1.2 | 1.2 | 1.2 | 1.2 | 1.2 | 1.2 | 1.2 | 1.2 | 1.2 |
| NOCCELER TBzTD | 4.5 | 4.5 | 4.5 | 4.5 | 4.5 | 4.5 | 4.5 | 4.5 | 4.5 | 4.5 | 4.5 | 4.5 | 4.5 | 4.5 |
| PU particles 2 | | | | | | | | | | | 20 | | | |
| PU particles 4 | 20 | 20 | 20 | 20 | 20 | 20 | | | | | | | | |
| PU particles 8 | | | | | | | | | | | | | * | |
| PU particles 11 | | | | | | | | | | | | | | 20 |
| PMMA particles 1 | | | | | | | 20 | | | | | | | |
| PMMA particles 2 | | | | | | | | 20 | | | | | | |
| Silicone particles 1 | | | | | | | | | 20 | | | | | |
| Silicone particles 2 | | | | | | | | | | 20 | | 20 | | |

TABLE 4-2-continued

| | Example | | | | | | | Comparative Example 5 | Example 19 | Comparative Example 6 | 7 | 8 | Example 20 | Comparative Example 9 |
|---|---|---|---|---|---|---|---|---|---|---|---|---|---|---|
| | 12 | 13 | 14 | 15 | 16 | 17 | 18 | | | | | | | |
| Processing condition | | | | | | | | | | | | | | |
| Elongation at break [%] | 70 | 73 | 74 | 80 | 84 | 89 | 78 | 88 | 84 | 75 | 76 | 77 | 75 | 73 |
| Take-up ratio [%] | 83 | 92 | 91 | 80 | 78 | 72 | 83 | 81 | 84 | 84 | 83 | 87 | 103 | 84 |
| Electron current in electron beam irradiation [mA] | 25.0 | 35.0 | 35.0 | 35.0 | 30.0 | 25.0 | 35.0 | 35.0 | 35.0 | 35.0 | 4.7 | 35.0 | 35.0 | 35.0 |

*) Used in very small amount in order to form convex portions by fusion with surface.

TABLE 5-1

| | Example | | | | | | | |
|---|---|---|---|---|---|---|---|---|
| | 1 | 2 | 3 | 4 | 5 | 6 | 7 | 8 |
| State of surface | | | | | | | | |
| Martens hardness of gap-forming concave portion wall [N/mm$^2$] | 15.0 | 15.0 | 15.0 | 15.0 | 19.2 | 20.5 | 4.8 | 15.0 |
| Martens hardness of elastic particles [N/mm$^2$] | 1.0 | 3.0 | 2.0 | 0.1 | 1.0 | 1.0 | 1.0 | 1.0 |
| State of elastic particles | Exposed | Exposed | Exposed | Exposed | Exposed | Exposed | Exposed | Exposed |
| Gap portion distance [μm] | 40 | 44 | 42 | 36 | 41 | 41 | 44 | 12 |
| Rz [μm] | 22 | 31 | 27 | 9 | 25 | 25 | 21 | 7 |
| Height of convex portions of elastic particles [μm] | 6 | 7 | 6 | 5 | 6 | 6 | 6 | 2 |
| Orientation degree of center of gravity of elastic particle and center of gravity of gap [°] | 6 | 6 | 6 | 7 | 6 | 6 | 6 | 10 |
| Evaluation result | | | | | | | | |
| Toner contamination (spot-like image unevenness) | A | B | A | A | A | B | A | A |
| Stepped unevenness-like contamination | A | A | A | B | A | A | B | A |
| Charging uniformity (horizontal streak) | A | A | A | A | A | A | A | B |

| | Example | | | Comparative Example | | | |
|---|---|---|---|---|---|---|---|
| | 9 | 10 | 11 | 1 | 2 | 3 | 4 |
| State of surface | | | | | | | |
| Martens hardness of gap-forming concave portion wall [N/mm$^2$] | 15.0 | 15.0 | 15.0 | 15.0 | 11.3 | 15.0 | 15.0 |
| Martens hardness of elastic particles [N/mm$^2$] | 1.0 | 1.0 | 1.0 | — | 1.0 | 0.09 | 4.00 |
| State of elastic particles | Exposed | Exposed | Exposed | — | Exposed | Exposed | Exposed |
| Gap portion distance [μm] | 20 | 62 | 65 | — | 0 | 36 | 46 |
| Rz [μm] | 9 | 27 | 28 | 2.5 | 5 | 8 | 33 |
| Height of convex portions of elastic particles [μm] | 3 | 10 | 11 | — | 5 | 6 | 7 |

TABLE 5-1-continued

| | | | | | | | |
|---|---|---|---|---|---|---|---|
| Orientation degree of center of gravity of elastic particle and center of gravity of gap [°] | 8 | 3 | 3 | — | — | 7 | 6 |
| Evaluation result | | | | | | | |
| Toner contamination (spot-like image unevenness) | A | A | B | D | D | A | D |
| Stepped unevenness-like contamination | A | A | A | C | C | D | B |
| Charging uniformity (horizontal streak) | A | A | A | D | C | B | A |

TABLE 5-2

| | Example | | | | | | | Comparative |
|---|---|---|---|---|---|---|---|---|
| | 12 | 13 | 14 | 15 | 16 | 17 | 18 | Example 5 |
| State of surface | | | | | | | | |
| Martens hardness of gap-forming concave portion wall [N/mm$^2$] | 5.0 | 15.7 | 17.8 | 20.0 | 19.8 | 19.0 | 15.0 | 15.0 |
| Martens hardness of elastic particles [N/mm$^2$] | 1.0 | 1.0 | 1.0 | 1.0 | 1.0 | 1.0 | 1.0 | 30.0 |
| State of elastic particles | Exposed | Exposed | Exposed | Exposed | Exposed | Exposed | Exposed | Exposed |
| Gap portion distance [μm] | 44 | 4 | 5 | 70 | 71 | 100 | 44 | 50 |
| Rz [μm] | 21 | 9 | 11 | 30 | 31 | 34 | 20 | 31 |
| Height of convex portions of elastic particles [μm] | 6 | 5 | 5 | 6 | 6 | 6 | 5 | 11 |
| Orientation degree of center of gravity of elastic particle and center of gravity of gap [°] | 6 | 15 | 11 | 3 | 3 | 2 | 4 | 4 |
| Roller evaluation | | | | | | | | |
| Toner contamination (spot-like image unevenness) | A | B | A | A | B | B | A | C |
| Stepped unevenness-like contamination | A | A | A | A | A | A | A | B |
| Charging uniformity (horizontal streak) | A | A | A | A | A | A | A | A |

| | Example | Comparative Example | | | Example | Comparative |
|---|---|---|---|---|---|---|
| | 19 | 6 | 7 | 8 | 20 | Example 9 |
| State of surface | | | | | | |
| Martens hardness of gap-forming concave portion wall [N/mm$^2$] | 15.0 | 15.0 | 2.0 | 15.0 | 15.0 | 15.0 |
| Martens hardness of elastic particles [N/mm$^2$] | 1.0 | 50.0 | 3.0 | 50.0 | 1.0 | 1.0 |
| State of elastic particles | Exposed | Exposed | Exposed | Coated | Exposed | Exposed |
| Gap portion distance [μm] | 48 | 53 | 44 | 0 | 1.8 | 41 |
| Rz [μm] | 23 | 33 | 31 | 11 | 10 | 20 |
| Height of convex portions of elastic particles [μm] | 6 | 15 | 7 | 5 | 2 | 5 |

TABLE 5-2-continued

| | | | | | | |
|---|---|---|---|---|---|---|
| Orientation degree of center of gravity of elastic particle and center of gravity of gap [°] | 4 | 3 | 4 | — | 46 | 6 |
| Roller evaluation | | | | | | |
| Toner contamination (spot-like image unevenness) | A | D | B | D | B | C |
| Stepped unevenness-like contamination | A | C | D | D | A | A |
| Charging uniformity (horizontal streak) | A | A | A | A | B | A |

TABLE 6

| Particle No. | Material | Average particle diameter [μm] | Hardness of particles [N/mm$^2$] | Elastic recovery power [%] |
|---|---|---|---|---|
| PU particles 1 | Polyurethane | 15 | 4 | 84 |
| PU particles 2 | Polyurethane | 15 | 3 | 83 |
| PU particles 3 | Polyurethane | 15 | 2 | 84 |
| PU particles 4 | Polyurethane | 15 | 1 | 83 |
| PU particles 5 | Polyurethane | 15 | 0.1 | 85 |
| PU particles 6 | Polyurethane | 15 | 0.09 | 85 |
| PU particles 7 | Polyurethane | 4 | 1 | 83 |
| PU particles 8 | Polyurethane | 6 | 1 | 84 |
| PU particles 9 | Polyurethane | 30 | 1 | 85 |
| PU particles 10 | Polyurethane | 31 | 1 | 85 |
| PU particles 11 | Polyurethane | 15 | 1 | 69 |
| PMMA particles 1 | Polymethyl methacrylate | 15 | 1 | 74 |
| PMMA particles 2 | Polymethyl methacrylate | 15 | 30 | 71 |
| Silicone particles 1 | Silicone | 15 | 1 | 78 |
| Silicone particles 2 | Silicone | 15 | 50 | 75 |

Among Examples 1 to 20, the following tendency was observed: as the Martens hardness of the elastic particles was smaller than that of the elastic material forming the gap, the convex portions were higher, and the long diameter of the gap was longer, the spot-like contamination and the stepped unevenness-like contamination were more suppressed. In addition, the following tendency was observed: as the convex portions were higher and the long diameter of the gap was longer, the horizontal streak-like image unevenness was more suppressed.

Meanwhile, in Comparative Example 1, the convex portions by the elastic particles were not present, and hence the spot-like image unevenness was evaluated as D. In Comparative Example 2, the gap was not present, and hence the spot-like image unevenness was evaluated as D. In Comparative Example 3, the Martens hardness of the elastic particles was less than 0.1 N/mm$^2$, and hence the external additive was sunk into the elastic particles, with the result that the stepped unevenness-like image unevenness was evaluated as D. In Comparative Example 4, the Martens hardness of the elastic particles was more than 3.0 N/mm$^2$, resulting in the cracking of toner, and hence the spot-like image unevenness was evaluated as D. In Comparative Examples 5 and 6, the Martens hardness of the elastic particles was more than 3.0 N/mm$^2$, resulting in the cracking of toner, and hence the spot-like image unevenness was evaluated as C and D, respectively. In Comparative Example 7, the Martens hardness of the gap-forming concave portion wall was smaller than the Martens hardness of the elastic particles, and the external additive was sunk into the portion in which the outer edge of the elastic particle and the outer edge of the concave portion were separated, and hence the stepped unevenness-like image unevenness was evaluated as D. In Comparative Example 8, the gap was buried in the covering layer to preclude the convex portion from deforming toward the gap, and an increase in stress to the elastic particles caused by a load became higher as compared to the case of having the gap, resulting in the crushing of toner, and hence the spot-like image unevenness was evaluated as D. In Comparative Example 9, the elastic recovery power of the elastic particles was less than 70%, and after the separation of the charging member and the photosensitive member, the convex portions derived from the elastic particles could not return to a height sufficient for maintaining charging uniformity, and hence the spot-like image unevenness was evaluated as C.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-210021, filed Oct. 26, 2015, and Japanese Patent Application No. 2016-156601, filed Aug. 9, 2016 which are hereby incorporated by reference herein in their entirety.

What is claimed is:

1. A charging member, comprising:

an electro-conductive support; and a surface layer having in an outer surface thereof, concave portions independent of each other, each of which holds an elastic particle positioned in each of the concave portions, the elastic particles being exposed at a surface of the charging member to form a convex portion in the surface of the charging member, wherein when each of the concave portions and the elastic particle held in each of the concave portions are orthogonally projected on a surface of the support and orthogonal projection image is obtained, in the orthogonal projection image, a site exists in which an outer edge of a projection image derived from each of the concave portions and an outer edge of a projection image derived from the elastic particle in the respective concave portions are separated, a part of a wall of each of the concave portions constitutes a part of the surface of the charging member, the elastic particle has an elastic recovery power We (%) of 70% or more, and has a Martens hardness of 0.1 to 3.0 N/mm$^2$, the Martens hardness of the elastic particle is lower than a Martens hardness measured at a surface of the part of the wall constituting the surface of the charging member, an average value of acute angles is 0° to less than 45°, each of the acute angles being formed by (I) a line segment and (II) a longitudinal direction of the charging member, the line segment connecting (i) a center of gravity of a gap formed by separation of the elastic particle and each of the concave portion, and (ii) a center of gravity of the elastic particle, the elastic recovery power is determined by We (%)=We/Wt×100 where We is elastic deformation work and Wt is mechanical driving total work, We and Wt being measured by using a microhardness meter with a square pyramid shaped diamond as an indenter, the elastic particle has an average particle diameter of 6 to 30 μm, and a distance of the site in which the outer edge of the projection image derived from the elastic particle and the outer edge of the projection image derived from the each of the concave portions are separated is ⅓ or more of the average particle diameter of the elastic particle and 70 μm or less.

2. A charging member according to claim 1, wherein the elastic particle has a Martens hardness of 1.0 to 2.0 N/mm$^2$.

3. A charging member according to claim 1, wherein the Martens hardness measured at a surface of the part of the wall constituting the surface of the charging member, ranges from 5.0 to 20.0 N/mm$^2$.

4. An electrophotographic apparatus, comprising a charging member comprising:

an electro-conductive support; and a surface layer having in an outer surface thereof, concave portions independent of each other, each of which holds an elastic particle positioned in each of the concave portions, the elastic particles being exposed at a surface of the charging member to form a convex portion in the surface of the charging member, wherein when each of the concave portions and the elastic particle held in each of the concave portions are orthogonally projected on a surface of the support and orthogonal projection image is obtained, in the orthogonal projection image, a site exists in which an outer edge of a projection image derived from each of the concave portions and an outer edge of a projection image derived from the elastic particle in the respective concave portions are separated, a part of a wall of each of the concave portions constitutes a part of the surface of the charging member, the elastic particle has an elastic recovery power We (%) of 70% or more, and has a Martens hardness of 0.1 to 3.0 N/mm$^2$, the Martens hardness of the elastic particle is lower than a Martens hardness measured at a surface of the part of the wall constituting the surface of the charging member, an average value of acute angles is 0° to less than 45°, each of the acute angles being formed by (I) a line segment and (II) a longitudinal direction of the charging member, the line segment connecting (i) a center of gravity of a gap formed by separation of the elastic particle and each of the concave portion, and (ii) a center of gravity of the elastic particle, the elastic recovery power is determined by We (%)=We/Wt×100 where We is elastic deformation work and Wt is mechanical driving total work, We and Wt being measured by using a microhardness meter with a square pyramid shaped diamond as an indenter, the elastic particle has an average particle diameter of 6 to 30 μm, and a distance of the site in which the outer edge of the projection image derived from the elastic particle and the outer edge of the projection image derived from the each of the concave portions are separated is ⅓ or more of the average particle diameter of the elastic particle and 70 μm or less.

5. A charging member according to claim 1, wherein the average value of acute angles is 0° to 20°.

* * * * *